US008964251B2

(12) United States Patent
Matsuzaki

(10) Patent No.: US 8,964,251 B2
(45) Date of Patent: Feb. 24, 2015

(54) IMAGE PROCESSING APPARATUS, IMAGE PROCESSING METHOD, AND STORAGE MEDIUM

(71) Applicant: Canon Kabushiki Kaisha, Tokyo (JP)

(72) Inventor: Masanori Matsuzaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 13/672,427

(22) Filed: Nov. 8, 2012

(65) Prior Publication Data

US 2013/0121710 A1 May 16, 2013

(30) Foreign Application Priority Data

Nov. 10, 2011 (JP) ..... 2011-246703

(51) Int. Cl.
*G03G 13/01* (2006.01)
*G03G 15/01* (2006.01)
*G03G 15/00* (2006.01)

(52) U.S. Cl.
CPC ..... *G03G 13/01* (2013.01); *G03G 15/01* (2013.01); *G03G 15/5029* (2013.01); *G03G 15/5062* (2013.01)
USPC ..... 358/1.9; 358/504

(58) Field of Classification Search
None
See application file for complete search history.

(56) References Cited

U.S. PATENT DOCUMENTS

| | | | | |
|---|---|---|---|---|
| 7,227,668 | B2 * | 6/2007 | Paul | 358/1.9 |
| RE42,071 | E * | 1/2011 | Nakayama | 399/49 |
| 8,243,343 | B2 * | 8/2012 | Takashima | 358/461 |
| 2004/0114157 | A1 * | 6/2004 | Linder et al. | 358/1.9 |
| 2005/0117927 | A1 * | 6/2005 | Tanaka et al. | 399/49 |
| 2006/0028671 | A1 * | 2/2006 | Katayanagi | 358/1.14 |
| 2007/0188541 | A1 * | 8/2007 | Hoshino | 347/21 |
| 2009/0296118 | A1 * | 12/2009 | Tsukamoto | 358/1.9 |
| 2011/0063633 | A1 * | 3/2011 | Ernst et al. | 358/1.9 |
| 2011/0122428 | A1 * | 5/2011 | Itagaki et al. | 358/1.9 |
| 2012/0188596 | A1 * | 7/2012 | Niles et al. | 358/1.15 |
| 2012/0250095 | A1 * | 10/2012 | Bestmann | 358/2.1 |
| 2013/0100191 | A1 * | 4/2013 | Miyamoto et al. | 347/14 |

FOREIGN PATENT DOCUMENTS

JP 2005-175806 A 6/2005

* cited by examiner

*Primary Examiner* — Kimberly A Williams
(74) *Attorney, Agent, or Firm* — Canon USA Inc. IP Division

(57) ABSTRACT

An image processing apparatus includes a first acquisition unit for acquiring a target value and a first surface characteristic value that is a surface characteristic of a first chart, a second acquisition unit for acquiring a second surface characteristic value that is a surface characteristic of a second chart, and a calibration unit for calibrating, when a difference between the first and second surface characteristic values is smaller than a threshold value, a mixed color using the target value and a measured value of the second chart.

27 Claims, 19 Drawing Sheets

IMAGE PROCESSING APPARATUS, IMAGE PROCESSING METHOD, AND STORAGE MEDIUM

BACKGROUND OF THE INVENTION

1. Field of the Invention

The claimed invention generally relates to image processing and, more particularly, to an image processing apparatus and an image processing method for correcting the tint of a printer, and a storage medium storing a program for generating an image processing parameter.

2. Description of the Related Art

As the performance of an electrophotographic apparatus has been improved in recent years, an electrophotographic apparatus realizing the same image quality as that of a printing machine has appeared. However, the issue that remains is that a variation amount of colors is larger than that of the printing machine due to instability specific to electrophotography.

Therefore, a conventional electrophotographic apparatus includes a calibration technique for generating a one-dimensional look up table (LUT) for gradation correction corresponding to each of cyan, magenta, yellow, and black (hereinafter, referred to as C, M, Y, and K) toners. The LUT is a table representing output data corresponding to input data separated with specific interval, and can represent a non-linear characteristic that cannot be expressed in an arithmetic expression.

A method for generating the one-dimensional LUT will be described. A printer outputs a chart including data, which differ in gradation, corresponding to the C, M, Y, and K toners. A scanner or a colorimeter then reads the output chart, to acquire a density value. The read density value is compared with a target prepared in advance in the printer, to generate a one-dimensional LUT (1D-LUT) for correction independently for each of the C, M, Y, and K toners.

However, a non-linear difference occurs for a "mixed color" particularly in the electrophotographic apparatus even if the 1D-LUT corrects a gradation characteristic of each color, so that a tint is not easy to ensure. The "mixed color" is a color using a plurality of toners in gray or the like using red (R), green (G), blue (B), and CMY.

As a solution to the above-mentioned issue, a "mixed color" calibration technique is discussed in Japanese Patent Application Laid-Open No. 2005-175806. The outline of the "mixed color" calibration technique will be described below. A chart generated in the "mixed color" is output, to obtain a measured value using the scanner or the colorimeter. The obtained "measured value" is then compared with a "target value", to generate a corrected value.

The "target value" represents a characteristic of a mixed color (hereinafter, referred to as a mixed color characteristic) of an image output at any timing of the electrophotographic apparatus. The "measured value" represents the current mixed color characteristic of the electrophotographic apparatus. A difference between the "measured value" and the "target value" is obtained, to generate the corrected value so that the mixed color characteristic of the electrophotographic apparatus is brought as close to a state of the "target value" as possible.

The user can register the "target value" using a user interface (UI) at any timing. Calibration is performed using the "target value" registered by the user so that the mixed color characteristic of the electrophotographic apparatus can be continuously maintained at timing designated by the user.

If the user registers the "target value", a sheet used at the time of the registration and a sheet used during the calibration are preferably the same. If the sheets differ, a particular issue is that they differ in "paper white" serving as a white color of paper itself. The "paper white" can be acquired at a quantitative value such as L*a*b. The L*a*b is one of device-independent color spaces determined by International Commission on Illumination (CIE), where "L*" represents a luminance, and "a*" and "b*" represent a hue and a saturation, respectively.

An effect of the difference in the "paper white" can be reduced using a known technique called "white point correction" by acquiring the above-mentioned L*a*b.

If a glossy "coated sheet" is used for mixed color calibration, however, a measurement result deviates depending on its "glossiness", resulting in a deteriorated accuracy of the calibration.

A sheet used during calibration by the conventional electrophotographic apparatus is a "plain sheet". If a sheet used at the time of registration and the sheet during the calibration differ, the two types of sheets differ in "paper white" while being substantially the same in glossiness.

On the other hand, the "coated sheet" differs in not only "paper white" but also a "glossiness" depending on its brand. A common index such as L*a*b has not been established for the "glossiness". Moreover, the "glossiness" is significantly difficult for the user to quantitatively determine by seeing the sheet.

However, a measurement device such as a scanner or a colorimeter is greatly affected by the "glossiness". More specifically, even if electrophotographic apparatuses having the same mixed color characteristic respectively output charts, a measurement result of a "mixed color" differs when the charts differ in the "glossiness". While a range affected by the "paper white" is centered on a color having a high luminance (e.g., a white color), a range affected by the "glossiness" affects a color in general. Accordingly, the effect is not easy to reduce by using "white point correction" of a known technique.

SUMMARY OF THE INVENTION

According to an aspect of the claimed invention, an image processing apparatus includes a first acquisition unit configured to acquire a target value and a first surface characteristic value that is a surface characteristic of a first chart, a second acquisition unit configured to acquire a second surface characteristic value that is a surface characteristic of a second chart, and a calibration unit configured to calibrate, when a difference between the first surface characteristic value and the second surface characteristic value is smaller than a threshold value, a mixed color using the target value and a measured value of the second chart.

According to an aspect of the claimed invention, the surface characteristic value of the first chart used when the target value has been acquired and the surface characteristic value of the second chart are compared, to calibrate the mixed color to correct the measured value of the second chart to the target value when the difference between the surface characteristic values is within the threshold value. This can prevent an accuracy of calibration from being deteriorated by calibrating the mixed color using the chart that greatly differs in surface characteristic from the chart used when the target value has been acquired.

Further features and aspects of the claimed invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the claimed invention and, together with the description, serve to explain the principles of the claimed invention.

DESCRIPTION OF THE EMBODIMENTS

Various exemplary embodiments, features, and aspects of the claimed invention will be described in detail below with reference to the drawings.

In a first exemplary embodiment of the claimed invention, a method for previously acquiring a "glossiness" when a target value is registered and using the acquired "glossiness" when a mixed color is calibrated, to prevent deterioration in accuracy will be described.

Figure 1:
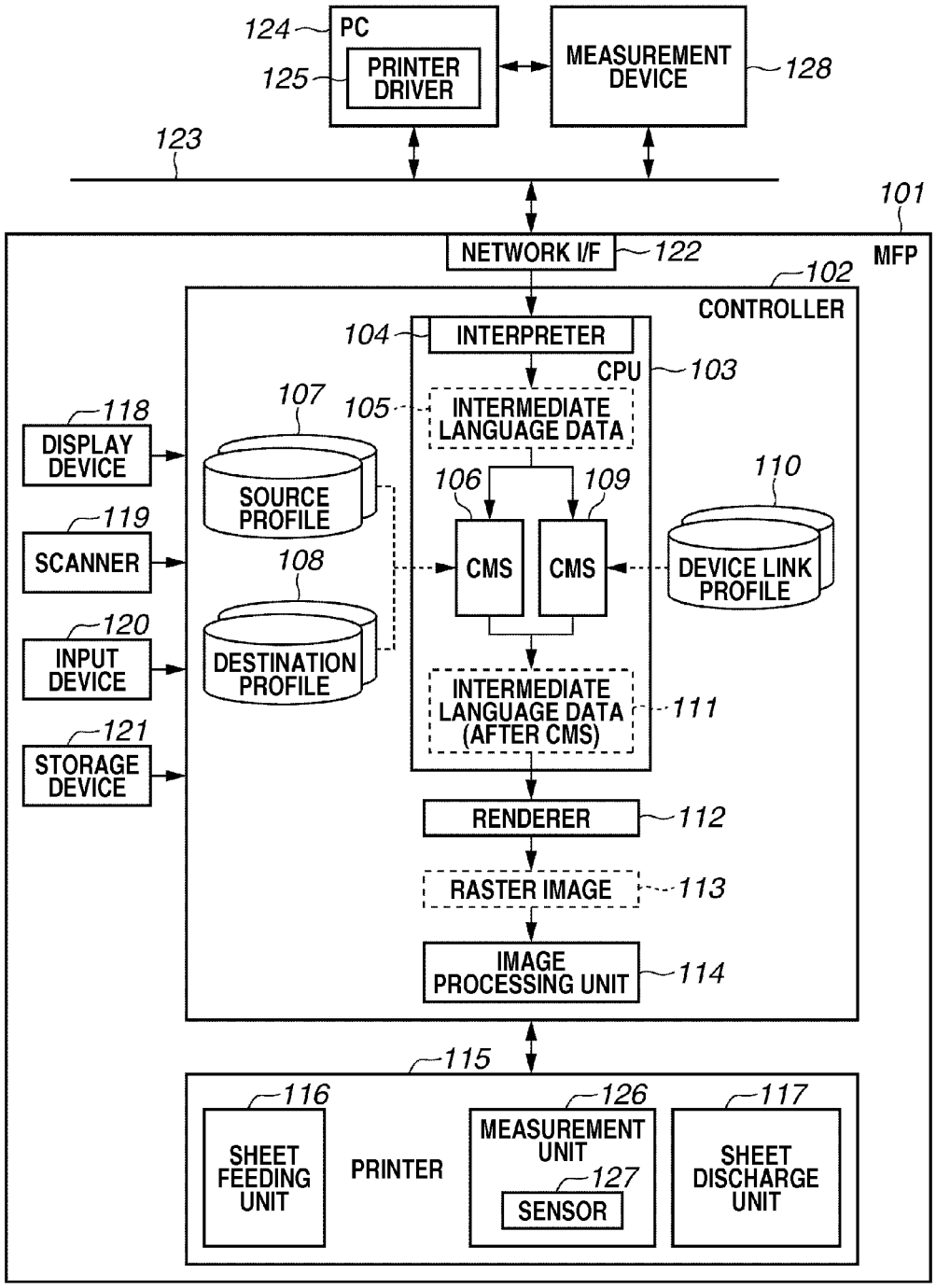
FIG. 1 is a block diagram illustrating a configuration of a system.

FIG. 1 illustrates a configuration of a system in the present exemplary embodiment. A multi function peripheral (MFP) 101 serving as an image processing apparatus using C, M, Y, and K toners is connected to a network 123. A personal computer (PC) 124 is connected to the MFP 101 via the network 123. A printer driver 125 in the PC 124 sends print data to the MFP 101.

The MFP 101 will be described in detail. A network interface (I/F) 122 receives the print data. A controller 102 includes a central processing unit (CPU) 103, a renderer 112, and an image processing unit 114. An interpreter 104 in the CPU 103 interprets a page description language (PDL) portion of the received print data, and generates intermediate language data 105.

A color management system (CMS) 106 performs color conversion using a source profile 107 and a destination profile 108 to generate intermediate language data (after CMS) 111.

The source profile 107 is a profile for converting a device-dependent color space such as RGB or CMYK into a device-independent color space such as L*a*b or XYZ determined by CIE. XYZ is a device-independent color space, similarly to L*a*b, and represents a color as three-types of stimulus values. The destination profile 108 is a profile for converting a device-independent color space into a CMYK color space that depends on a device (printer 115).

On the other hand, a CMS 109 performs color conversion using a device link profile 110, and generates intermediate language data (after CMS) 111. The device link profile 110 is a profile for directly converting a device-dependent color space such as RGB or CMYK into a CMYK color space that depends on the device (printer 115). Which of the CMSs 106 and 109 is selected depends on setting in the printer driver 125.

While the CMS is used depending on the type of profile in the present exemplary embodiment, one CMS may handle a plurality of types of profiles. The type of profile is not limited to examples cited in the present exemplary embodiment. Any type of profile may be used if the CMYK color space that depends on the device (printer 115) is used.

The renderer 112 generates a raster image 113 from the generated intermediate language data (after CMS) 111. The image processing unit 114 processes the raster image 113 and an image read by a scanner 119. Details of the image processing unit 114 will be described below.

The printer 115, which is connected to the controller 102, forms output data on sheets using colored toners such as C, M, Y, and K toners. The printer 115 includes a sheet feeding unit 116 for feeding the sheets, a sheet discharge unit 117 for discharging the sheets on which the output data has been formed, and a measurement unit 126.

The measurement unit 126 includes a sensor 127 capable of acquiring a spectral reflectance and a value in a device-independent color space such as L*a*b or XYZ. The measurement unit 126 reads the data, which has been output onto the sheet by the printer 115, using the sensor 127, and sends read numerical information to the controller 102. The controller 102 performs an arithmetic operation using the numerical information, and uses the numerical information for correcting a single color or a mixed color. Details of the measurement unit 126 will be described below.

A display device 118 displays a UI representing an instruction to a user and a state of the MFP 101 on a display unit. In the present exemplary embodiment, the flow of processing performed when the mixed color is calibrated is presented to the user.

The scanner 119 includes an auto document feeder. The scanner 119 irradiates a bundle-shaped or one document image with a light source (not illustrated), and forms a reflected document image on a solid-state image sensor such as a charge coupled device (CCD) sensor with a lens. A raster-shaped image reading signal is obtained as image data from the solid-state image sensor.

An input device 120 is an interface for accepting input from the user. A part of the input device 120 is a touch panel, and is thus integrated with the display device 118.

A storage device 121 stores data processed by the controller 102 and data received by the controller 102.

A measurement device 128 is an external measurement device on the network 123 or connected to the PC 124, and can acquire a spectral reflectance and a value in a device-independent color space such as L*a*b or XYZ, similarly to the measurement unit 126.

The details described above regarding the configuration of the system illustrated in FIG. 1 functionally interact in a manner corresponding to various units. For example, the configuration of the system of FIG. 1 may functionally operate as an image processing apparatus including a first acquisition unit configured to acquire a target value and a first surface characteristic value that is a surface characteristic of a first chart; a second acquisition unit configured to acquire a second surface characteristic value that is a surface characteristic of a second chart; and a calibration unit configured to calibrate, when a difference between the first surface characteristic value and the second surface characteristic value is smaller than a threshold value, a mixed color using the target value and a measured value of the second chart.

Figure 2:
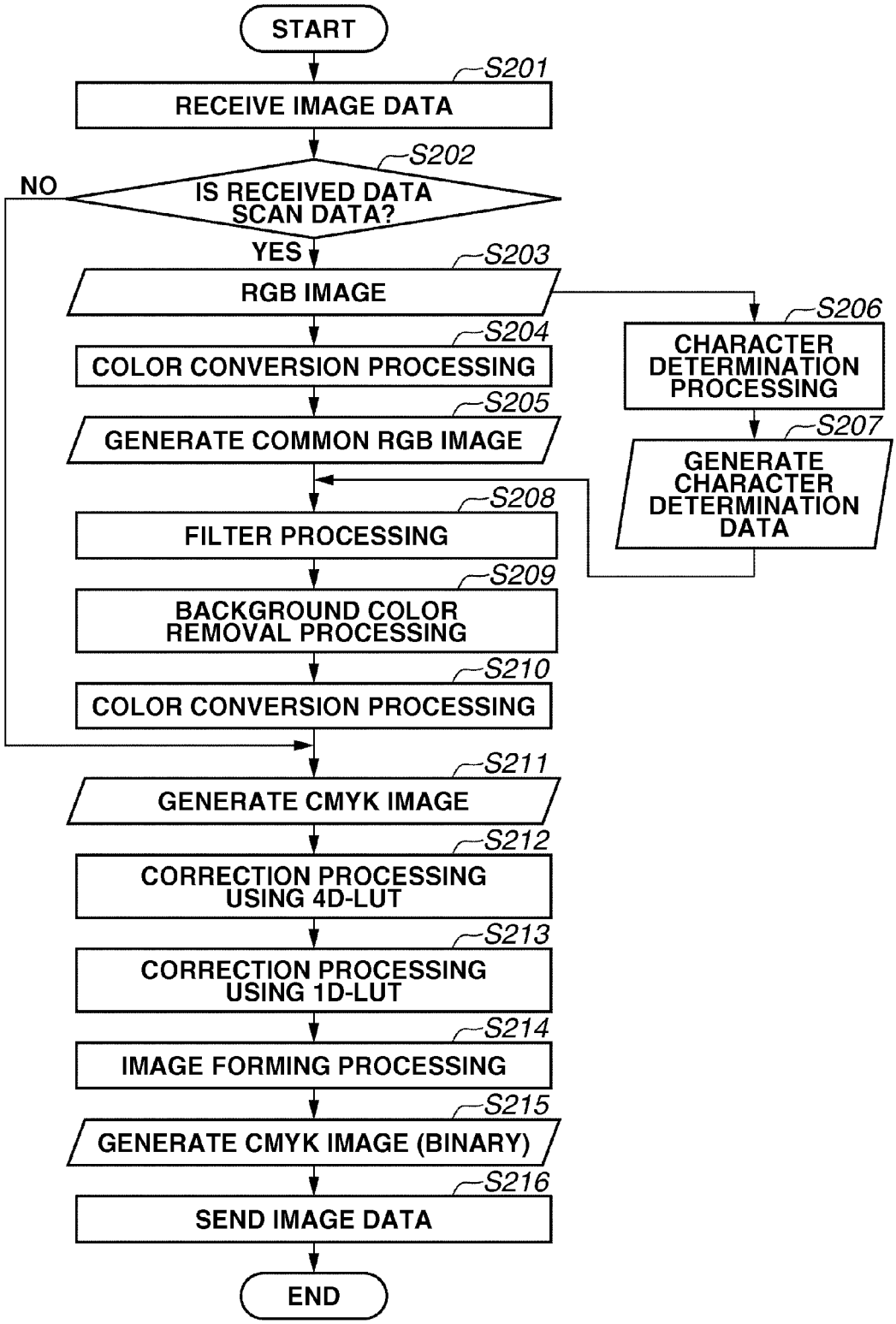
FIG. 2 is a flowchart illustrating a flow of image processing.

A flow of image processing performed by the image processing unit 114 will be described below with reference to FIG. 2. FIG. 2 illustrates the flow of the image processing performed for the raster image 113 or the image read by the scanner 119. The flow of the processing illustrated in FIG. 2 is implemented when an application specific integrated circuit (ASIC) (not illustrated) in the image processing unit 114 performs the processing.

In step S201, the image processing unit 114 receives image data. In step S202, the image processing unit 114 determines whether the received image data is scan data received from the scanner 119 or the raster image 113 sent from the printer driver 125.

If the received data is not the scan data (NO in step S202), it is the raster image 113, which has been subjected to bitmap expansion by the renderer 112. In step S211, the image processing unit 114 converts the raster image 113 into a CMYK image 211 defined by a device-dependent CMYK color space by the CMS 106.

If the received data is the scan data (YES in step S202), then in step S203, the image processing unit 114 determines that the scan data is an RGB image 203. In step S204, the image processing unit 114 performs color conversion processing. In step S205, the image processing unit 114 generates a common RGB image 205. The common RGB image 205 is defined by a device-independent RGB color space, and can be converted into a device-independent color space such as L*a*b* by an arithmetic operation.

On the other hand, in step S206, the image processing unit 114 performs character determination processing, to generate character determination data 207. In step S207, the image processing unit 114 detects an edge of the RGB image 205, to generate character determination data 207.

In step S208, the image processing unit 114 then performs filter processing using the character determination data 207 on the common RGB image 205. Different filter processing operations are respectively performed on a character portion and a portion other than the character portion using the character determination data 207.

In step S209, the image processing unit 114 then performs background color removal processing. In step S210, the image processing unit 114 performs color conversion processing. In step S211, the image processing unit 114 generates the CMYK image 211 from which a background has been removed.

In step S212, the image processing unit 114 then performs mixed color correction processing using a 4D-LUT. The 4D-LUT is a four-dimensional LUT for converting input colors of C, M, Y, and K into different colors of C, M, Y, and K, and is generated by the "mixed color calibration processing" in the present exemplary embodiment. The 4D-LUT is used so that the tint of a mixed color, which is a color using a plurality of toners, can be corrected. A method for generating the 4D-LUT for correcting the tint of the mixed color will be described below.

In step S213, the image processing unit 114 corrects a gradation characteristic of each of single colors C, M, Y, and K using a 1D-LUT after correcting the tint of the mixed color in step S212. The 1D-LUT is a one-dimensional LUT for correcting each of the colors C, M, Y, and K.

A method for generating the 1D-LUT will be described. First, a chart including data, which differs in gradation, respectively corresponding to toners in colors C, M, Y, and K is output. A density value of the output chart is then acquired using the scanner 119 or the measurement unit 126. The acquired density value is compared with a target prepared in advance, to generate the 1D-LUT for correcting a difference from the target independently for each of the colors C, M, Y, and K. Processing for generating the 1D-LUT is referred to as "single color calibration processing".

In step S214, the image processing unit 114 finally performs image formation processing such as screen processing or error diffusion processing. In step S215, the image processing unit 114 generates a CMYK image (binary) 215. In step S216, the image processing unit 114 sends image data to the printer 115.

Details of the sensor 127 will be described below with reference to FIG. 3.

The sensor 127 in the measurement unit 126 needs to be fixed and set in the apparatus to read a sheet to be conveyed. Accordingly, data to be read on a chart needs to be increased in a sheet conveyance direction 306 if increased. However, the number of data that can be read by one sheet is limited. When the number of sensors is increased perpendicularly to the sheet conveyance direction 306, two sensors perpendicularly arranged can simultaneously read two patches perpendicularly arranged on the chart, for example.

Figure 3:
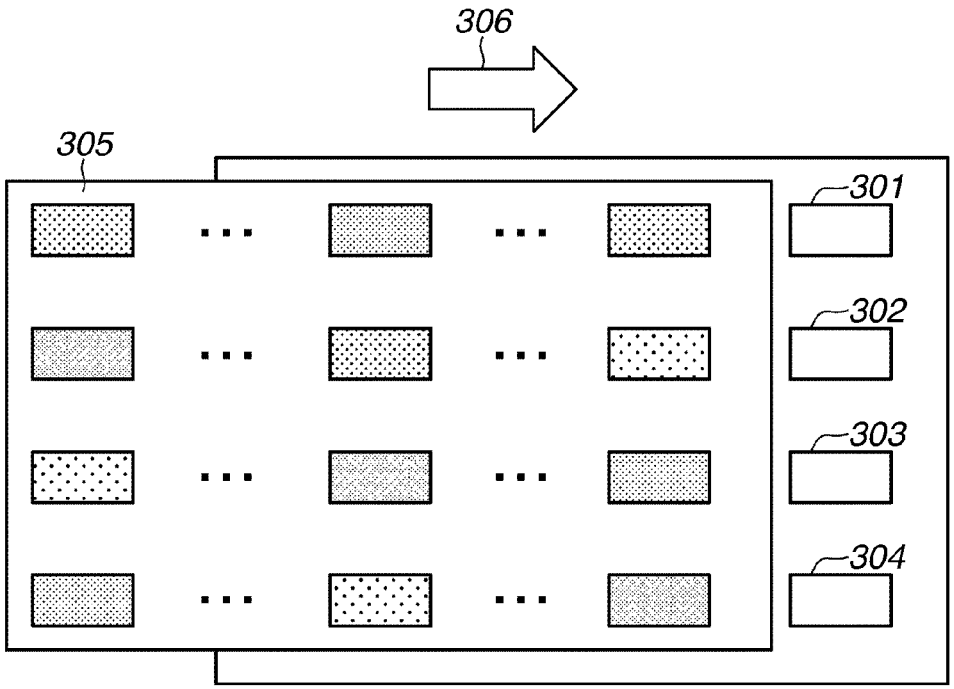
FIG. 3 is a diagram schematically illustrating a measurement unit in an image processing apparatus.

In FIG. 3, four sensors 301, 302, 303, and 304 are used. On a chart 305, data are respectively arranged to match positions where the sensor 301, 302, 303, and 304 are fixed. When the chart 305 is conveyed, and the data on the chart 305 passes over each of the sensors, a measured value is acquired, and is sent to the controller 102 by the measurement unit 126.

Figure 19:
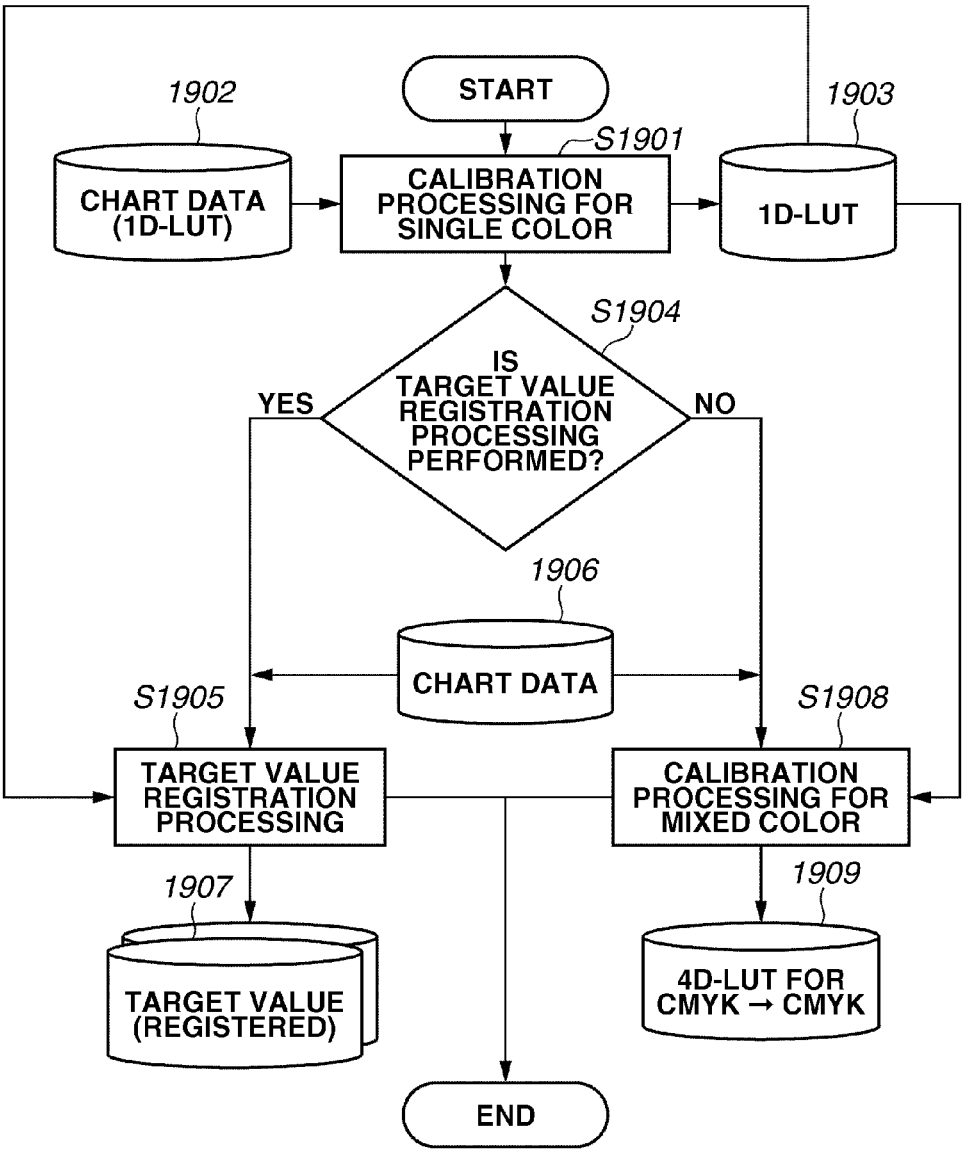
FIG. 19 is a flowchart illustrating entire calibration processing.

A relationship between single color calibration processing for generating a 1D-LUT and mixed color calibration processing for generating a 4D-LUT will be described below with reference to FIG. 19.

The flow of the correction processing using the 1D-LUT performed in step S213) performed after the correction processing using the 4D-LUT performed in step S212 has been described above. After single color calibration is performed to correct a single color, mixed color calibration is performed. A program for realizing each step of the flow is loaded in random access memory (RAM) and executed by the CPU 103 in the controller 102. The display device 118 displays an instruction to a user on a UI, and an instruction from the user is accepted from the input device 120.

In step S1901, the CPU 103 performs the above-mentioned single color calibration processing using chart data for a 1D-LUT 1902 stored in the storage device 121, to generate a 1D-LUT 1903.

In step S1904, the CPU 103 then determines whether target value registration processing is performed according to the instruction from the user, which has been obtained by the display device 118 and the input device 120.

If the target value registration processing is performed (YES in step S1904), then in step S1905, the CPU 103 performs target value registration processing, described below, using chart data 1906 including a mixed color for a 4D-LUT stored in the storage device 121, to generate a target value (registered) 1907. In that case, processing is performed using the 1D-LUT 1903 that has been generated in step S1901.

If the target value registration processing is not performed (NO in step S1904), then in step S1908, the CPU 103 performs mixed color calibration processing, described below, using the chart data 1906 including a mixed color for a 4D-LUT stored in the storage device 121, to generate a 4D-LUT 1909 for CMYK→CMYK. In that case, processing is performed using the 1D-LUT 1903 that has been generated in step S1901.

A "target value" represents a mixed color characteristic of an image output at any timing of the electrophotographic apparatus. "Mixed color calibration" is performed, to correct a measured value of a mixed-color toner patch, which has been printed by mixing single-color toners, to this target value.

Calibration processing for generating a 4D-LUT for correcting a mixed color will be described below with reference to FIGS. 4 and 5.

Figure 4:
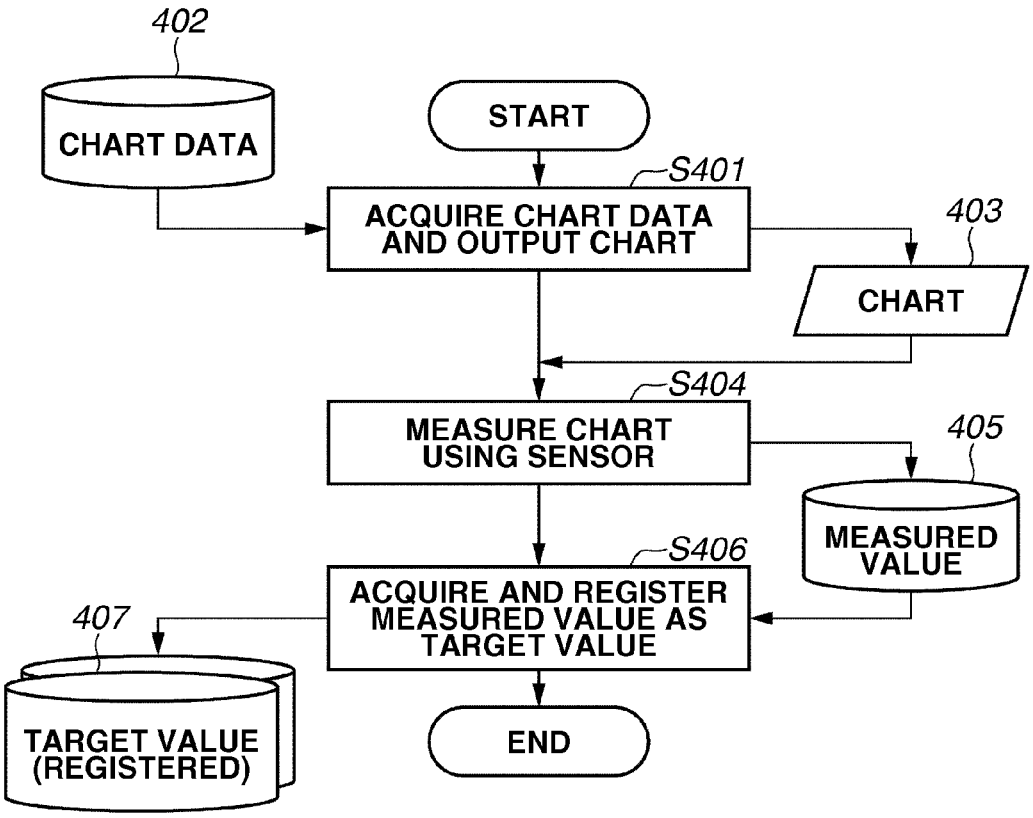
FIG. 4 is a flowchart illustrating target value registration processing.

FIG. 4 illustrates a flow of processing for registering a "target value" used during mixed color calibration. A program for realizing each step of the flow is loaded in the RAM and executed by the CPU 103 in the controller 102. Acquired data is stored in the storage device 121. The display device 118 displays an instruction to a user on a UI, and an instruction from the user is accepted from the input device 120.

In step S401, the CPU 103 acquires information about chart data 402 including a "mixed color" stored in the storage device 121, and performs image processing by the image processing unit 114, to output a chart 403 by the printer 115. The chart data 402 is based on the premise that it is measured by the measurement unit 126, similarly to the chart 305 illustrated in FIG. 3. When the image processing unit 114 performs image processing, the 1D-LUT 1903 generated before the image processing is used, as described above in FIG. 19.

In step S404, the CPU 103 then measures the chart 403 using the sensor 127 in the measurement unit 126, to acquire a measured value 405. The measured value 405 is a spectral reflectance or a value in a device-independent color space such as L*a*b or XYZ, which has been acquired by the measurement unit 126, and represents a mixed color characteristic of the printer 115 at the time of the target value registration.

In step S406, the CPU 103 finally acquires the obtained measured value 405 as a target value, and registers the acquired target value as a target value (registered) 407 in the storage device 121. The user can register the target value at any timing. Therefore, the target value (registered) 407 includes a plurality of target values (registered) 407. The target value (registered) 407 is a value in a device-independent color space, and is an L*a*b value in the present exemplary embodiment.

Figure 5:
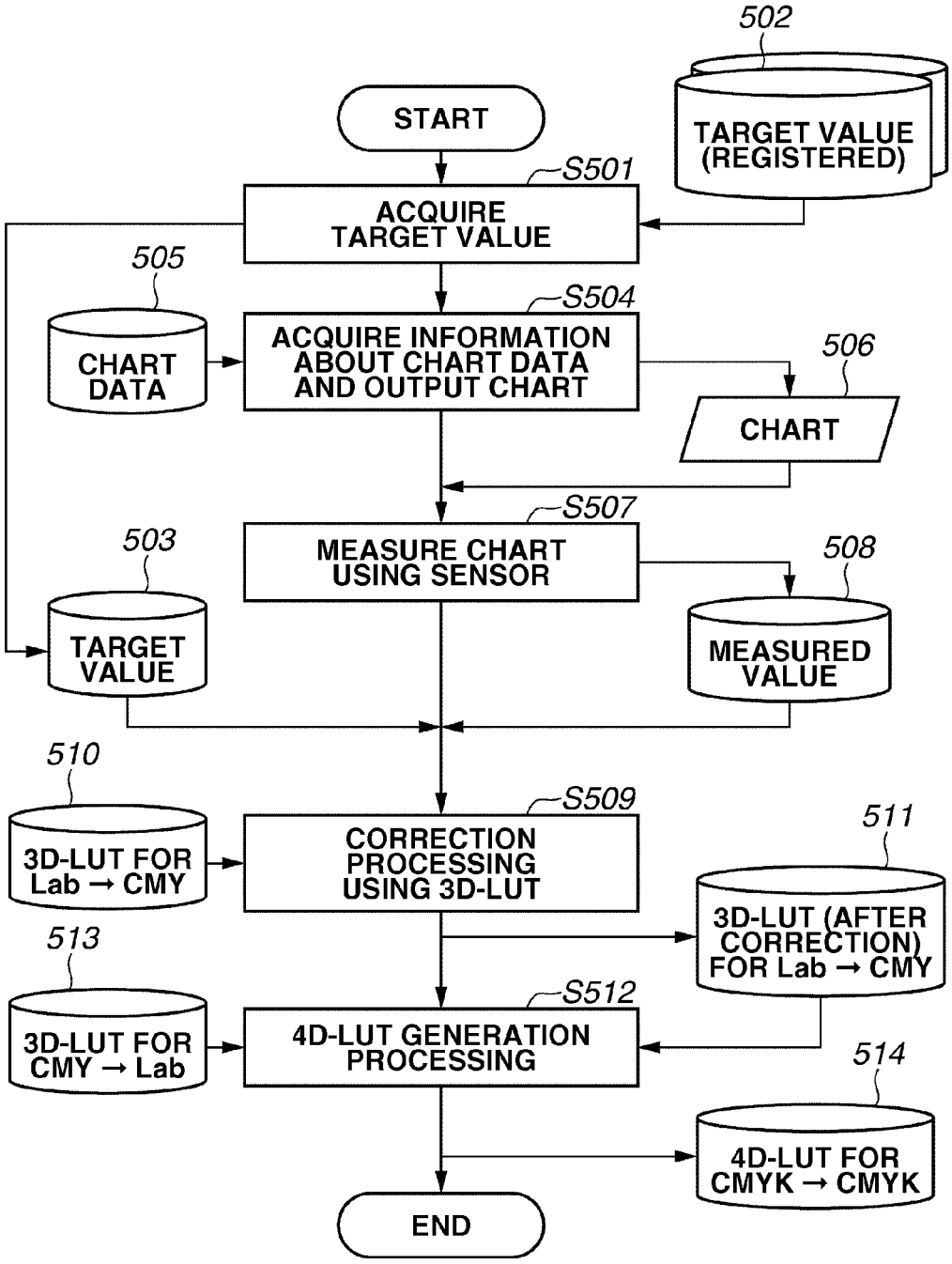
FIG. 5 is a flowchart illustrating mixed color calibration processing.

FIG. 5 illustrates a flow of mixed color calibration processing. A program for realizing each step of the flow is loaded in the RAM and executed by the CPU 103 in the controller 102. Acquired data is stored in the storage device 121. The display device 118 displays an instruction to a user on a UI, and an instruction from the user is accepted from the input device 120.

In step S501, the CPU 103 acquires a target value 503 from within target values (registered) 502 stored in the storage device 121 according to the instruction from the user, which has been obtained in the display device 118 and the input device 120. The target values (registered) 502 are the same as the target values (registered) 407 obtained in FIG. 4, and the target value 503 is obtained at any timing designated by the user.

In step S504, the CPU 103 then acquires information about chart data 505 including a "mixed color" stored in the storage device 121, and performs image processing by the image processing unit 114, to output a chart 506 by the printer 115. When the image processing unit 114 performs image processing, the 1D-LUT 1903 generated immediately before the image processing is used, as described above in FIG. 19.

In step S507, the CPU 103 then measures the chart 506 using the sensor 127 in the measurement unit 126, to acquire a measured value 508. The measured value 508 represents a mixed color characteristic of the printer 115 during calibration. The measured value 508 is a value in a device-independent color space, and is an L*a*b value in the present exemplary embodiment.

In step S509, the CPU 103 then acquires a 3D-LUT for L*a*b→CMY 510 stored in the storage device 121, and reflects a difference between the target value 503 and the measured value 508, to generate a 3D-LUT (after correction) for L*a*b→CMY 511. The 3D-LUT for L*a*b→CMY 510 is a three-dimensional LUT for outputting a CMY value corresponding to an input L*a*b value.

A specific generation method will be described below. A difference is added to the L*a*b value on the input side of the 3D-LUT for L*a*b→CMY 510, and performs an interpolation operation using the 3D-LUT for L*a*b→LUT 510 for the L*a*b value on which the difference has been reflected, to generate the 3D-LUT (after correction) for L*a*b→CMY 511.

In step S512, the CPU 103 then acquires a 3D-LUT for CMY→L*a*b 513 stored in the storage device 121, and performs an arithmetic operation using the 3D-LUT (after correction) for L*a*b→CMY 511, to generate a 4D-LUT for CMYK→CMYK 514. The 3D-LUT for CMY→L*a*b 513 is a three-dimensional LUT for outputting an L*a*b value corresponding to an input CMY value.

A specific generation method will be described below. A 3D-LUT for CMY→CMY is generated from the 3D-LUT for CMY→L*a*b 513 and the 3D-LUT (after correction) for L*a*b→CMY 511. The 4D-LUT for CMYK→CMYK 514 is then generated so that an input value and an output value of K become the same. The 3D-LUT for CMY→CMY is a three-dimensional LUT for outputting a CMY value after correction corresponding to an input CMY value.

In the above-mentioned conventional mixed color calibration processing, when a sheet used at the time of target value registration processing and a sheet used during mixed color calibration processing differ in glossiness, a difference in glossiness is added to the measured value 508, resulting in deterioration in accuracy. When the glossiness acquired when the chart 403 illustrated in FIG. 4 is output and the glossiness acquired when the chart 506 illustrated in FIG. 5 is output differ, the accuracy of the mixed color calibration is deteriorated.

The above-mentioned deterioration in accuracy can be prevented by performing the present exemplary embodiment illustrated in FIGS. 6 to 11.

Figure 6:
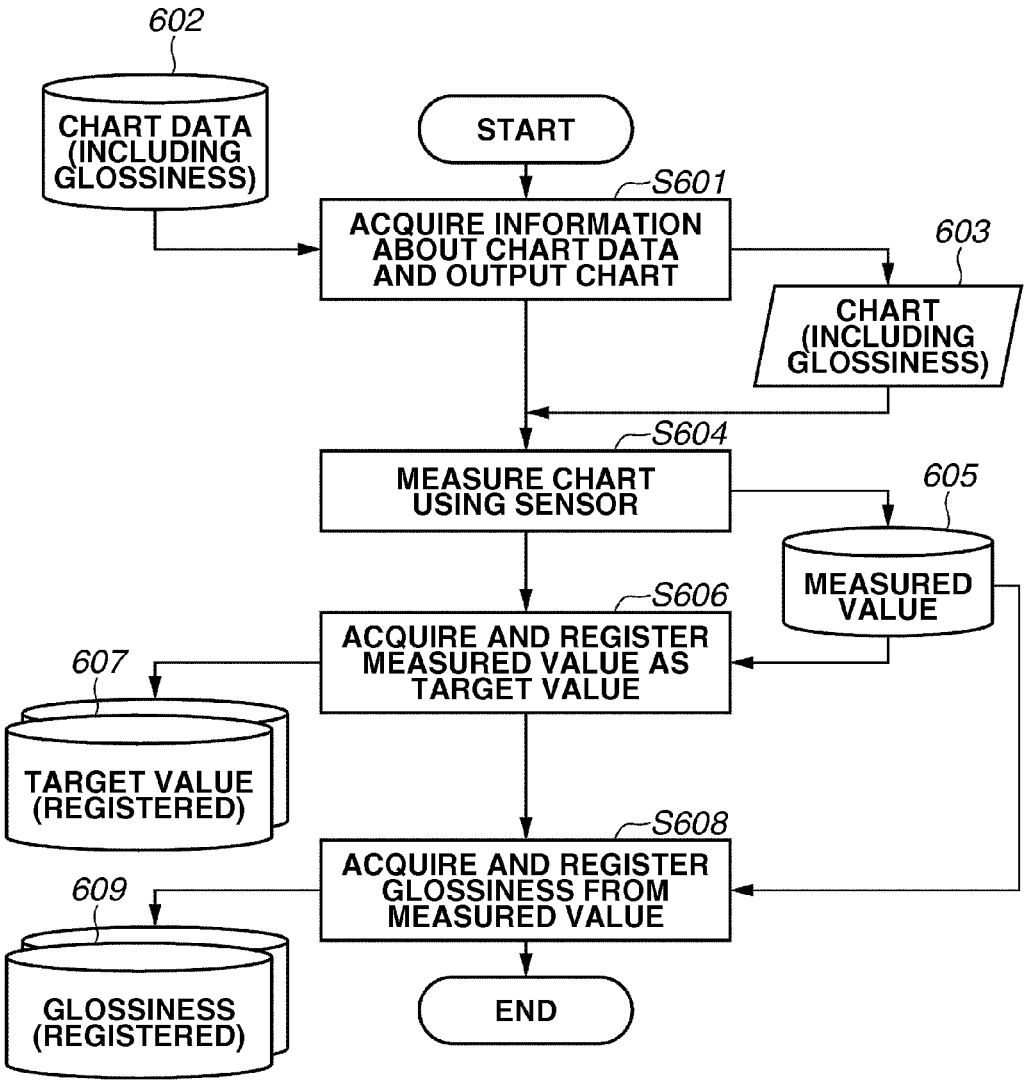
FIG. 6 is a flowchart illustrating a flow of target value registration processing performed in a first exemplary embodiment.

FIG. 6 illustrates a flow of the target value registration processing in the present exemplary embodiment. A program for realizing each step of the flow is loaded in the RAM and executed by the CPU 103 in the controller 102. Acquired data is stored in the storage device 121. The display device 118 displays an instruction to a user, and an instruction from the user is accepted from the input device 120.

In step S601, the CPU 103 first acquires information about chart data 602 including a "mixed color" and "glossiness acquiring data" stored in the storage device 121, and performs image processing by the image processing unit 114, to output a chart 603 by the printer 115. When the image processing is performed by the image processing unit 114, the 1D-LUT 1903 generated immediately before the image processing is used, as described above in FIG. 19.

Figure 8:
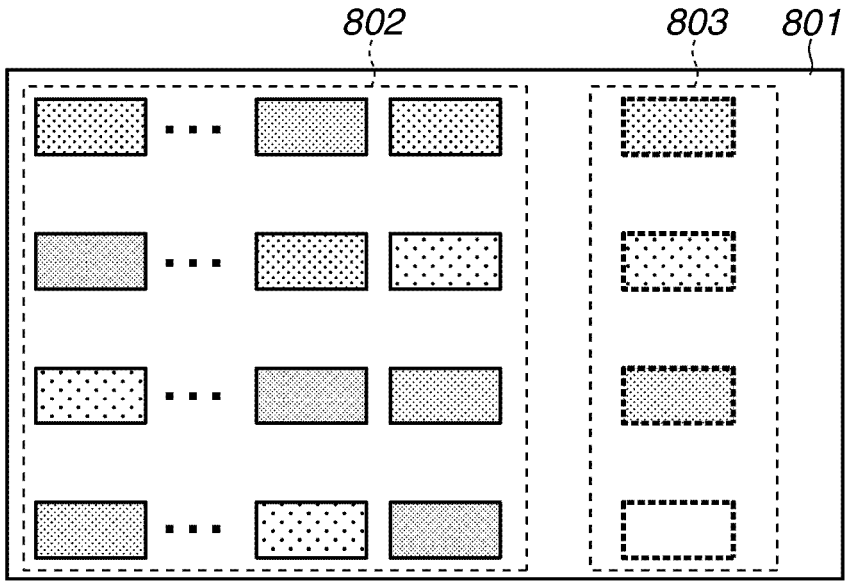
FIG. 8 illustrates a chart for mixed color calibration performed in the first exemplary embodiment.

An example of the chart 603 is illustrated in FIG. 8. Mixed color data 802 is arranged on a sheet 801. The mixed color data 802 is similar to that in the conventional technique. In the present exemplary embodiment, glossiness acquiring data 803 is arranged. The glossiness acquiring data 803 uses "single-color" data including one toner such as a C, M, Y, or K toner having a predetermined density in addition to paper white. The "single-color" data can be used because a "single color" such as C, M, Y, or K is previously corrected in the 1D-LUT generation processing, and target value registration processing and mixed color calibration processing are premised thereon. The predetermined density of each of the C, M, Y, and K toners is desirably high not to be affected by paper white.

In step S604, the CPU 103 then measures the chart 603 using the sensor 127 in the measurement unit 126, and acquires a measured value 605. The measured value 605 is a value representing a mixed color characteristic and a glossiness of the printer 115 at the time of target value registration, and is represented by a spectral reflectance or a value in a device-independent color space such as L*a*b or XYZ, which has been acquired in the measurement unit 126.

In step S606, the CPU 103 acquires data corresponding to a target value from within the obtained measured values 605, and registers the acquired data as a target value (registered) 607 in the storage device 121. Since the user can register the target value at any timing, like in the conventional technique, the target value (registered) includes a plurality of target values (registered) 607. The target value (registered) 607 is a value in a device-independent color space, and is an L*a*b value in the present exemplary embodiment.

In step S608, the CPU 103 finally acquires data corresponding to the glossiness from within the obtained measured values 605, and registers the acquired data as a glossiness (registered) 609 in the storage device 121. The glossiness (registered) 609 includes a plurality of glossinesses (registered) 609 because it is synchronized with the target value that has been registered at any timing by the user.

The glossiness will be described with reference to FIGS. 10, 11, and 18. The glossiness is calculated from the measured value 605 obtained from the measurement unit 126.

A calculation method will be described below. The measurement unit 126 acquires a spectral reflectance or a value in a device-independent color space such as L*a*b, as described above. The L*a*b can be represented by two-dimensional data particularly if "a" and "b" representing a hue/saturation are paid attention to. However, an amount of information is reduced, and the accuracy during glossiness determination is deteriorated. The spectral reflectance to be the basis of the L*a*b becomes high-dimensional data because it is acquired for each of wavelengths of 400 to 700 nm. Therefore, the accuracy during glossiness determination is improved, although a calculation time occurs. In the above-mentioned wavelength range, for example, data becomes 31-dimensional data when acquired every 10 nm.

Figure 10A:
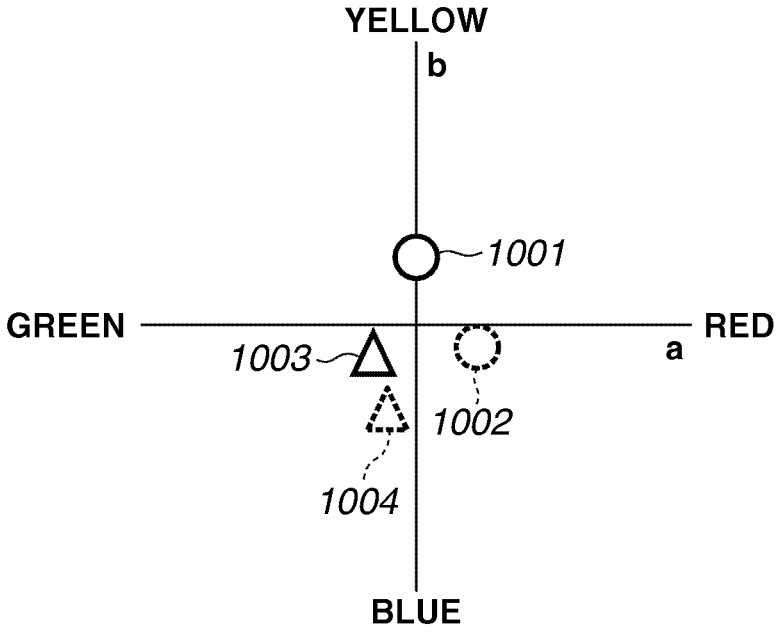
FIGS. 10A and 10B are graphs illustrating examples of glossiness at the time of a speed priority performed in the first exemplary embodiment.
Figure 10B:
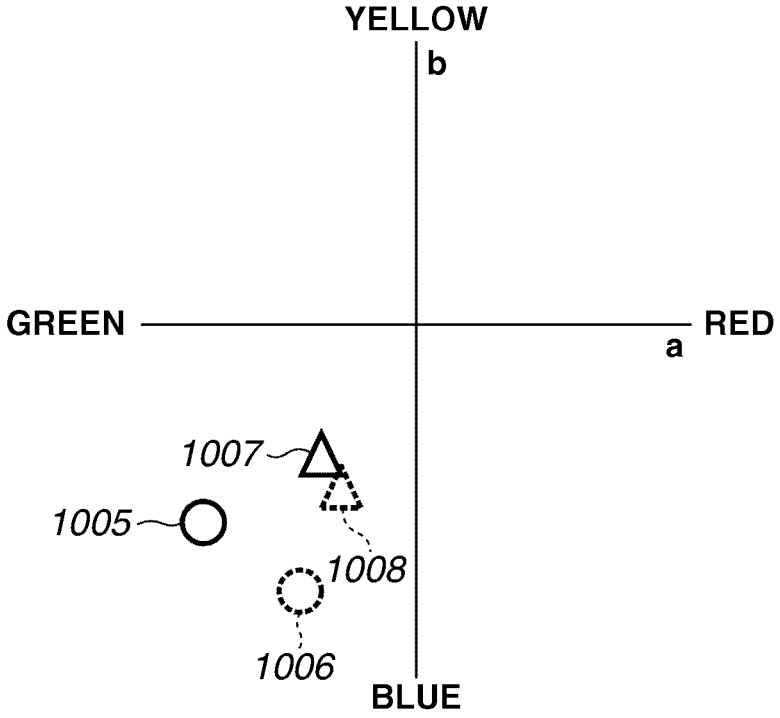

FIGS. 10A and 10B illustrate an example in which glossiness is represented by "a" and "b" representing a hue/saturation. FIG. 10A illustrates a glossiness of a paper white portion of a sheet, and FIG. 10B illustrates a glossiness of a portion, to which a cyan toner has been added (printed) at a predetermined density, of the sheet. A coated sheet A having a particular glossiness has a glossiness 1001 in its paper white portion. The coated sheet A has a glossiness 1005 in its portion to which a cyan toner has been added at a predetermined density.

A coated sheet B having a different glossiness from that of the coated sheet A has a glossiness 1002 in its paper white portion. The coated sheet B has a glossiness 1006 in its portion to which a cyan toner has been added at a predetermined density. A plain sheet A having a low glossiness has a glossiness 1003 in its paper white portion.

The plain sheet A has a glossiness 1007 in its portion to which a cyan toner has been added at a predetermined density. A plain sheet B having a different whiteness degree from that of the plain sheet A has a glossiness 1004 in its paper white portion. The plain sheet B has a glossiness 1008 in its portion to which a cyan toner has been added at a predetermined density.

The plain sheets A and B are similar in hue/saturation in both the paper white portions and the portions to which a cyan toner has been added if they respectively have similar glossinesses 1003 and 1004 and 1007 and 1008. The plain sheets A and B are substantially the same in hue/saturation particularly in the portions to which a cyan toner has been added because the portions are not affected by paper white.

On the other hand, the coated sheet A and the plain sheet A, which respectively have greatly different glossinesses 1001 and 1003, and 1005 and 1007, greatly differ in hue/saturation in both the paper white portions and the portions to which a cyan toner has been added. The sheets greatly differ in hue/saturation, as illustrated in FIG. 10B, if they differ in glossiness even in the portions to which a cyan toner has been added, where a difference does not easily occur between the plain sheets.

Further, the coated sheets A and B, which respectively have greatly different glossinesses 1001 and 1002, and 1005 and 1006, also greatly differ in hue/saturation in both the paper white portions and the portions to which a cyan toner has been added.

As described above, when a toner is printed on the coated sheet, the coated sheet greatly differs in hue/saturation depending on the glossiness thereof, unlike when a toner is printed on the plain sheet. Therefore, a difference in glossiness can be determined using a threshold value. A specific example of and a method for calculating the threshold value will be described below.

Figure 11A:
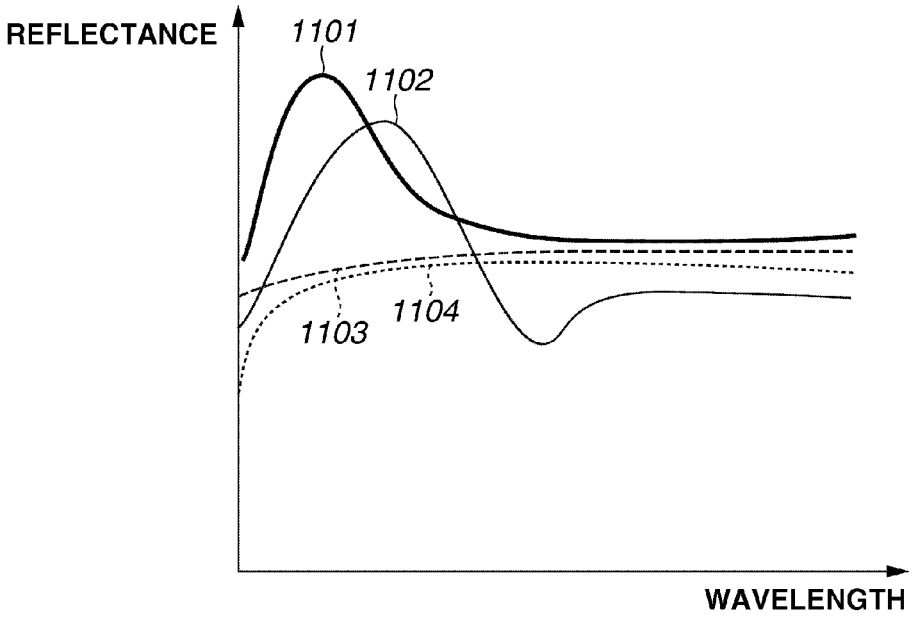
FIGS. 11A and 11B illustrate examples of glossiness at the time of an accuracy priority performed in the first exemplary embodiment.
Figure 11B:
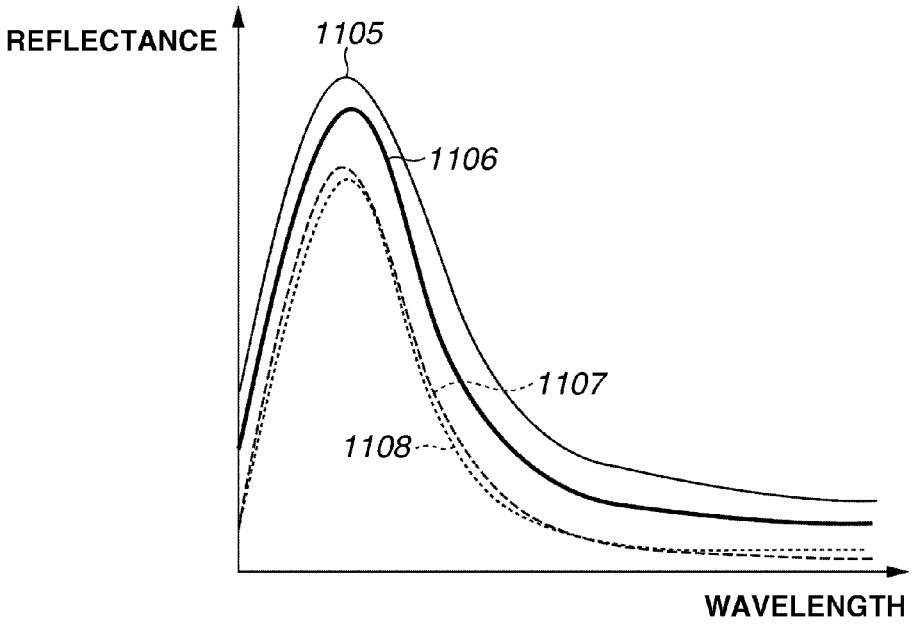

FIGS. 11A and 11B illustrate an example in which a glossiness is represented by a spectral reflectance. FIG. 11A illustrates a glossiness in a paper white portion of a sheet, and FIG. 11B illustrates a glossiness in a portion, to which a cyan toner has been added, of the sheet. A coated sheet A having a particular glossiness has a glossiness 1101 in its paper white portion. The coated sheet A has a glossiness 1105 in its portion to which a cyan toner has been added at a predetermined density.

A coated sheet B having a different glossiness from that of the coated sheet A has a glossiness 1102 in its paper white portion. The coated sheet B has a glossiness 1106 in its portion to which a cyan toner has been added at a predetermined density. A plain sheet A having a low glossiness has a glossiness 1103 in its paper white portion.

The plain sheet A has a glossiness 1107 in its portion to which a cyan toner has been added at a predetermined density. A plain sheet B having a different whiteness degree from that of the plain sheet A has a glossiness 1104 in its paper white portion. The plain sheet B has a glossiness 1108 in its portion to which a cyan toner has been added at a predetermined density.

The plain sheets A and B respectively have spectral reflectances similar in shape in both the paper white portions and the portions to which a cyan toner has been added if they respectively have similar glossinesses 1103 and 1104, and 1107 and 1108. The spectral reflectances of the plain sheets A and B are substantially the same in shape particularly in the portions to which a cyan toner has been added because the portions are not affected by paper white.

On the other hand, the coated sheet A and the plain sheet A, which respectively have greatly different glossinesses 1101 and 1103 and 1105 and 1107, respectively have spectral reflectances greatly different in shape in both the paper white portions and the portions to which a cyan toner has been added. The sheets respectively have high spectral reflectances greatly different in shape if they differ in glossiness even in the portions to which a cyan toner has been added, where a difference does not easily occur between the plain sheets.

Further, the coated sheets A and B, which respectively have greatly different glossinesses 1101 and 1102, and 1105 and 1106, also respectively have high spectral reflectances greatly different in shape in both the paper white portions and the portions to which a cyan toner has been added.

As described above, when printing is performed using the coated sheet, the spectral reflectance differs in shape depending on the glossiness, unlike when printing is performed using the plain sheet. Therefore, a difference in glossiness can be determined using a threshold value with higher accuracy than when determined using "a" and "b". However, a calculation time occurs to perform the determination because the number of processing data is large.

Figure 18:
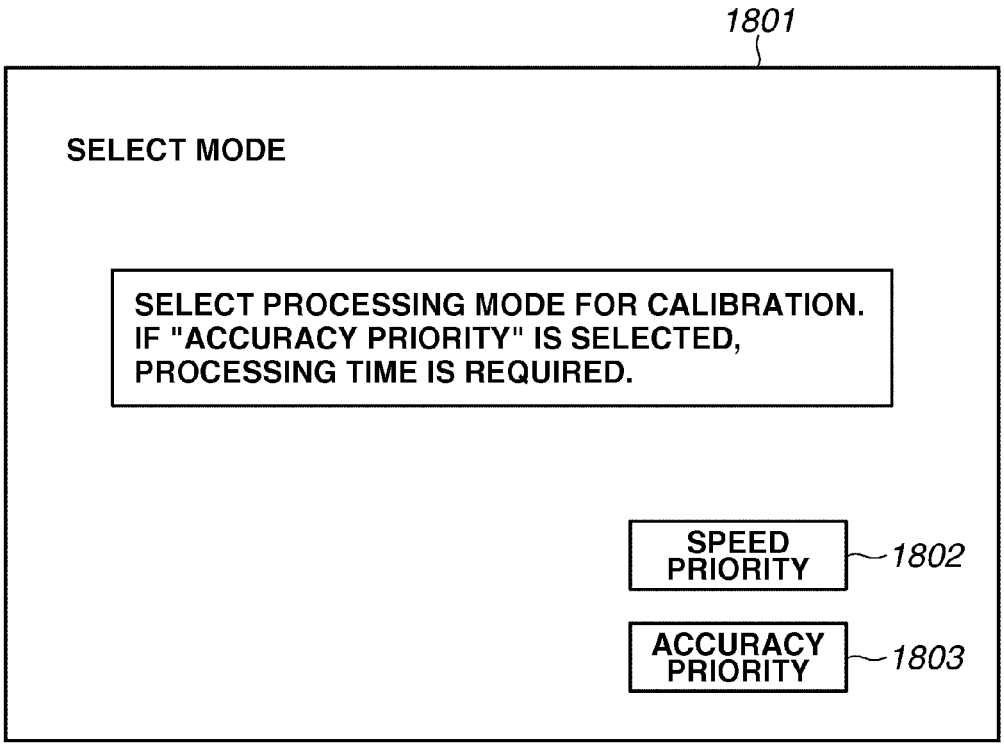
FIG. 18 illustrates a UI for selecting a mode during calibration performed in the first exemplary embodiment.

FIG. 18 illustrates a UI for causing a user to select which of glossinesses is to be used in consideration of characteristics of the glossinesses. The display device 118 displays an instruction to the user on the UI, and an instruction from the user is accepted from the input device 120.

A UI 1801 selects a mode for a glossiness determination, and a description about the mode is displayed thereon. A speed priority 1802 and an accuracy priority 1803 are touch-panel buttons on the display device 118. If the speed priority 1802 is selected, a hue/saturation represented by "a" and "b" illustrated in FIG. 10 is a glossiness. If the accuracy priority 1803 is selected, the spectral reflectance illustrated in FIG. 11 is a glossiness.

Figure 7:
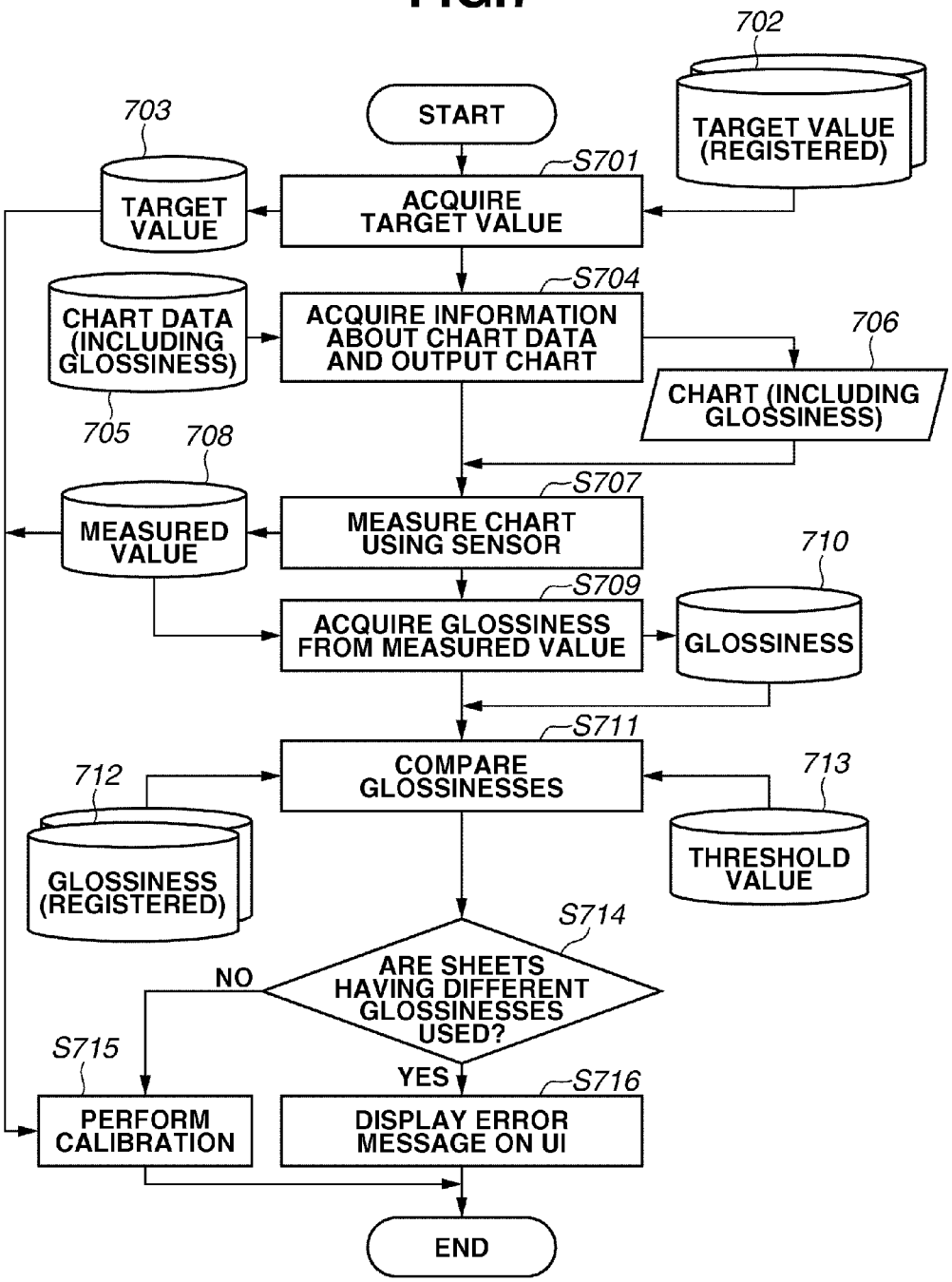
FIG. 7 is a flowchart illustrating a flow of mixed color calibration processing performed in the first exemplary embodiment.

FIG. 7 illustrates a flow of mixed color calibration processing in the present exemplary embodiment. A program for realizing each step of the flow is loaded in the RAM and executed by the CPU 103 in the controller 102. The display device 118 displays an instruction to a user on a UI, and an instruction from the user is accepted from the input device 120.

In step S701, the CPU 103 acquires a target value 703 from within a target values (registered) 702 stored in the storage device 121 according to the instruction from the user obtained in the display device 118 and the input device 120. The target values (registered) 702 are the same as the target values (registered) 607 obtained in FIG. 6, and the target value 703 is a target value at any timing designated by the user.

In step S704, the CPU 103 then acquires information about chart data 705 including a "mixed color" and "glossiness acquiring data" stored in the storage device 121, and performs image processing by the image processing unit 114, to output a chart 706 in the printer 115. When image processing is performed by the image processing unit 114, the 1D-LUT 1903 generated immediately before the image processing is used, as described above in FIG. 19.

In step S707, the CPU 103 then measures the chart 706 using the sensor 127 in the measurement unit 126, and acquires a measured value 708 (second acquisition). The measured value 708 represents a mixed color characteristic and a glossiness of the printer 115 during calibration.

In step S709, the CPU 103 acquires a glossiness 710 from the measured value 708.

In step S711, the CPU 103 then acquires, out of glossinesses (registered) 712 stored in the storage device 121, the glossiness corresponding to the target value 703. (second acquisition Further, the CPU 103 acquires a threshold value 713 stored in the storage device 121. The CPU 103 compares the glossinesses using acquired data (the glossiness corresponding to the target value 703) and the glossiness 710. Data representing the glossinesses used for the comparison differ depending on which of the "speed priority" 1802 and the "accuracy priority" 1803 has been selected by the UI illustrated in FIG. 18.

The threshold value 713 differs in a specific value depending on which of the "speed priority" 1802 and the "accuracy priority" 1803 has been selected on the UI 1801 illustrated in FIG. 18. An example is described below. In the "speed priority", the threshold value 713 has a value for each of "a" and "b" or a distance on a two-dimensional plane. In the "accuracy priority", the threshold value 713 has a value for each of 31-dimensional data.

Further, there is a plurality of glossinesses measured in a paper white portion or a portion to which a single-color toner such as a C, M, Y, or K toner has been added, as data representing a glossiness as illustrated in FIG. 8. Accordingly, the threshold value 713 may be retained for each measured color (e.g., white, C, M, Y, or K).

Values previously obtained by an experiment, respectively, in both the "speed priority" 1802 and the "accuracy priority" 1803, are stored as the threshold value 713 in the storage device 121.

A specific example of and a method for calculating a threshold value will be described below. A standard coated sheet is first defined. The standard coated sheet can be changed by a user. A difference between a glossiness of the standard coated sheet and a glossiness of a coated sheet other than the standard coated sheet and a difference between the glossiness of the standard coated sheet and a glossiness of a plain sheet are obtained, and a minimum value of the differences is stored as a threshold value 713.

Consider a case where the standard coated sheet is a coated sheet A having glossinesses 1001 and 1005, as illustrated in FIG. 10. In this case, a minimum value of differences between the glossiness 1001 measured in a paper white portion of the coated sheet A and glossinesses 1002 to 1004 measured in paper white portions of sheets other than the coated sheet A is calculated. Similarly, a minimum value of differences between the glossiness 1005 measured in a portion, to which a cyan toner has been added, of the coated sheet A and glossinesses 1006 to 1008 measured in portions, to which a cyan toner has been added, of sheets other than the coated sheet A is calculated.

The difference is a distance on an a-b plain. The difference may be obtained for each color. Further, a minimum value of the differences may be obtained as a threshold value 713. An example of a threshold value in FIG. 10 is expressed by the following equation (1):

$$TH=\sqrt{(a_c-a_t)^2+(b_c-b_t)^2} \quad (1)$$

TH: threshold value, $a_t/b_t$: a and b of standard coated sheet, $a_c/b_c$: a and b of sheet to be compared For at least each of the sheets, one threshold value TH is acquired by the foregoing equation (1).

In FIG. 11, the standard coated sheet is also a coated sheet A, like in FIG. 10. A minimum value of differences between a glossiness 1101 measured in a paper white portion of the coated sheet A and those of other sheets and a minimum value of differences between a glossiness 1105 measured in a portion, to which a cyan toner has been added, of the coated sheet A and those of the other sheets are found. However, FIG. 11 illustrates a spectral reflectance. Therefore, 31-dimensional difference data is first obtained every 10 nm, to calculate a total value. A minimum value of total values found for the sheets is the threshold value 713.

An example of the threshold value in FIG. 11 is expressed by the following equation (2):

$$TH=\Sigma_{n=1}^{n=31}\sqrt{(\mathrm{ref}_c(n)-\mathrm{ref}_t(n))^2} \quad (2)$$

TH: threshold value, $\mathrm{ref}_t$: spectral reflectance of standard coated sheet, $\mathrm{ref}_c$: spectral reflectance of sheet to be compared Similarly, for at least each of the sheets, one threshold value TH is acquired by the foregoing equation (2).

In step S714, the CPU 103 then determines whether sheets having different glossinesses are used as a result of determining a threshold value. This determination will be specifically described below. When a registered target value 703 is acquired, a glossiness 712 is acquired therefrom. A difference between the glossiness 712 and the glossiness of the standard sheet (the coated sheet A in the above-mentioned case) is acquired by the foregoing equation (1) or (2), to obtain a threshold value TH corresponding to a target value of the glossiness.

If a difference α between "the glossiness 710 acquired from the measured value" acquired in step S711 and the glossiness of the standard sheet is the threshold value TH or more, then in step S714, the CPU 103 determines that sheets having different glossinesses are used (YES in step S714), and the processing proceeds to step S716. On the other hand, if the difference α is the threshold value TH or less, then in step S714, the CPU 103 determines that sheets having different glossinesses are not used (NO in step S714), and the processing proceeds to step S715. If the threshold value 713 is retained for each measured color (e.g., white, C, M, Y, or K), the CPU 103 may determine that sheets having different glossinesses are used when the acquired difference α in glossiness is any threshold value or more.

If it is determined that the difference in glossiness is the threshold value or less, and sheets having different glossinesses are not used, there is no concern about deterioration in accuracy. Therefore, in step S715, the CPU 103 performs calibration processing, and the processing ends. The processing in step S715 is similar to those in steps S509 and S512 in the conventional technique, and hence description thereof is not repeated.

If it is determined that the difference in glossiness is the threshold value or more, and sheets having different glossinesses are used, there is concern about deterioration in accuracy. Therefore, in step S716, the CPU 103 displays an error message on a UI using the display device 118, and the processing ends.

Figure 9:
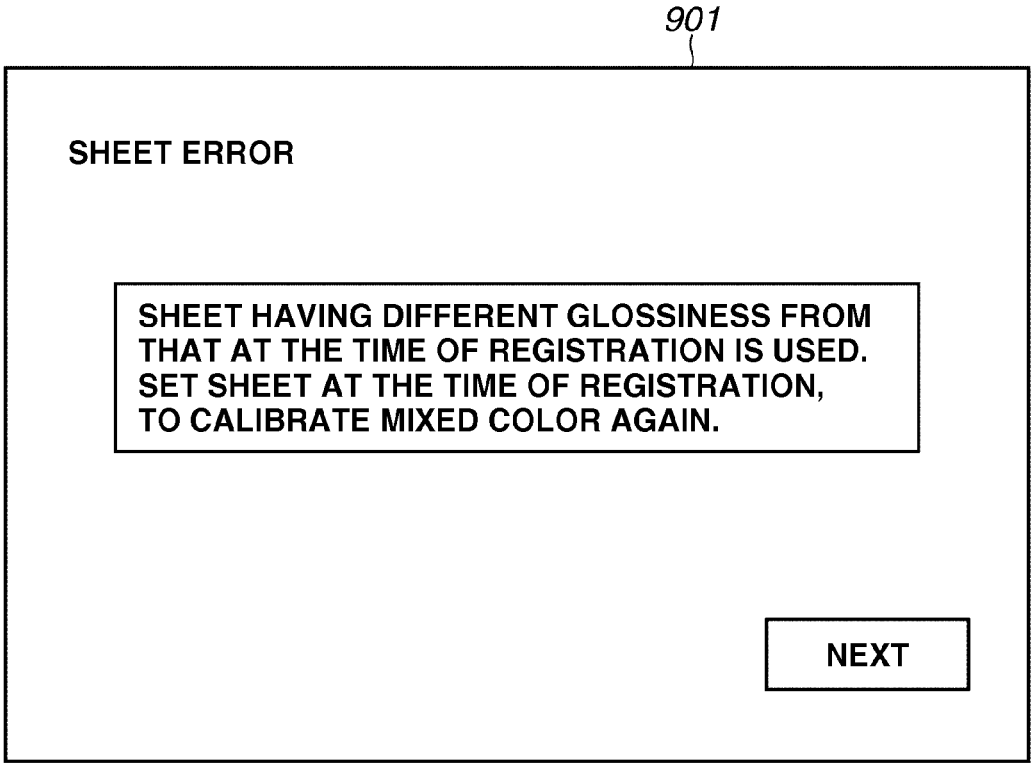
FIG. 9 illustrates a UI displayed during mixed color calibration performed in the first exemplary embodiment.

An example of the error message on the UI is illustrated in FIG. 9. On a UI 901, the fact that sheets having different glossinesses are respectively used at the time of target value registration and during mixed color calibration, is presented to the user, to urge the user to calibrate the mixed color again by changing the sheets.

While a target value, a measured value, and a glossiness have been described on the premise that the sensor 127 in the measurement unit 126 is used in the present exemplary embodiment, another measurement device may be used. For example, the scanner 119 may be used to acquire a luminance value and convert the acquired luminance value into a value in a device-independent color space such as L*a*b. The measurement device 128 serving as an external measurement device may be used.

While the "glossiness" is a hue/saturation or a spectral reflectance in the present exemplary embodiment, it may be any data such as luminance data.

While the "glossiness" has been used to determine a difference between sheets during mixed color calibration and at the time of target value registration in the present exemplary embodiment, any surface characteristic value may be used to determine the difference between sheets if it affects an accuracy of calibration. For example, transmissivity and smoothness (irregularity), which have been quantified, may be used.

According to the present exemplary embodiment, in a system for calibrating the mixed color using the sheets having different glossinesses, e.g., coated sheets, deterioration in accuracy during calibration due to a difference in the "glossiness" between the "target value" and the "measured value" can be prevented.

A second exemplary embodiment in which a measured value acquired when sheets having different glossinesses are used during mixed color calibration is newly registered as a target value will be described below.

In the above-mentioned first exemplary embodiment, the flow of the processing for comparing the glossinesses respectively corresponding to the target value and the measured value during mixed color calibration and displaying an error message when the glossinesses differ, to prevent deterioration in accuracy has been described.

However, a case where sheets having different glossinesses are used during mixed color calibration is not necessarily caused by a simple user's mistake of a sheet type. A case where a user changes a sheet to be used from a sheet having the previous glossiness to a sheet having a new glossiness may also be possible. A target value is to be newly registered to use a new sheet.

In the present exemplary embodiment, an example in which a measured value is newly registered as a target value when glossinesses differ will be described in consideration of the above-mentioned situation.

Figure 12:
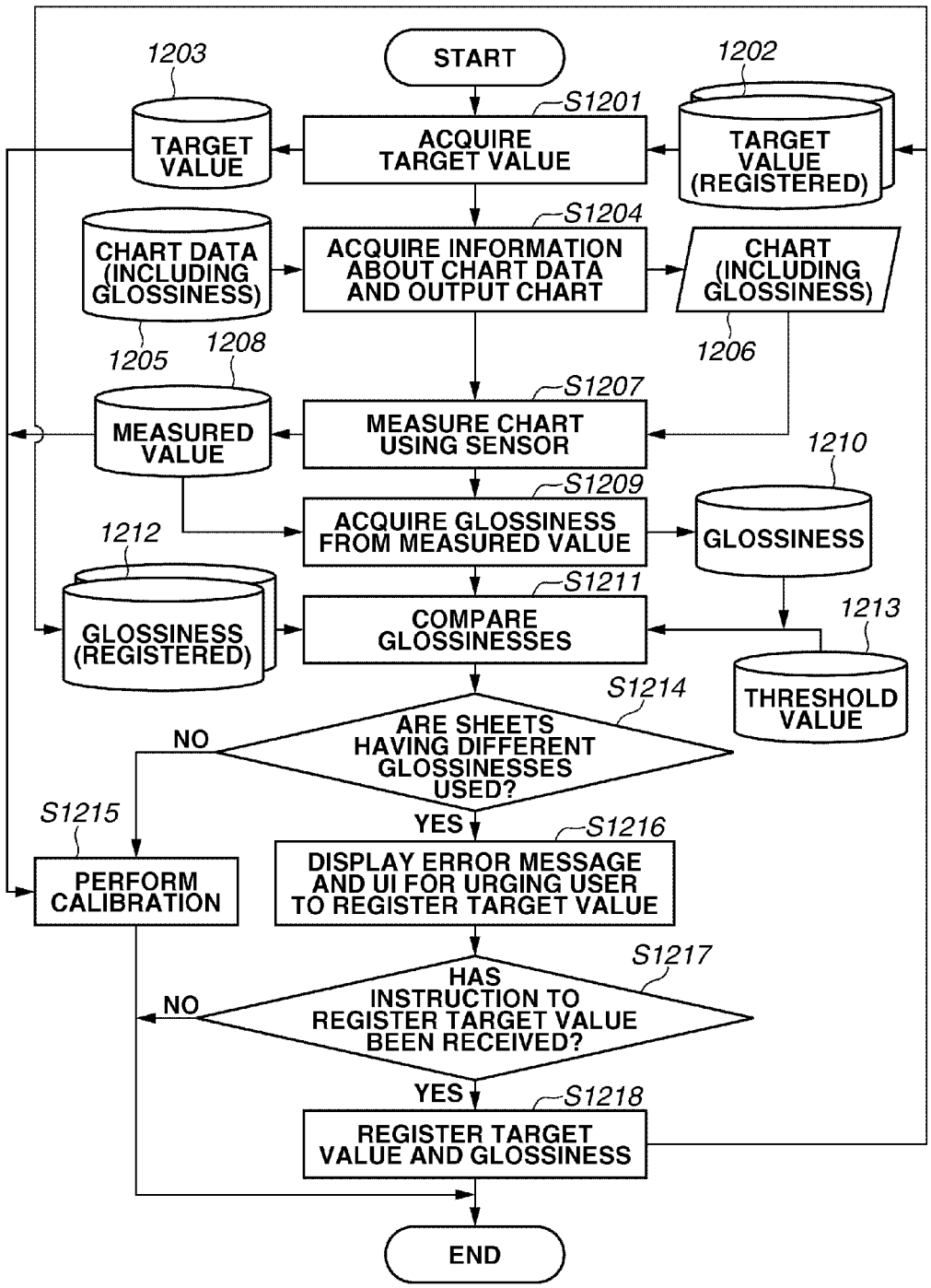
FIG. 12 is a flowchart illustrating mixed color calibration processing performed in a second exemplary embodiment.

FIG. 12 illustrates a flow of processing in the present exemplary embodiment. A program for realizing each step of the flow is loaded in the RAM and executed by the CPU 103 in the controller 102. Acquired data is stored in a storage device 121. A display device 118 displays an instruction to a user on a UI, and an instruction from the user is accepted from an input device 120.

The flow of processing in steps S1201 to S1215 illustrated in FIG. 12 is similar to the flow of processing in steps S701 to S715 illustrated in FIG. 7, and hence description thereof is not repeated.

If it is determined that sheets having different glossinesses are used, i.e., if it is determined that a difference $\alpha$ in glossiness between a measured value and a registered value is a threshold value TH or more (YES in step S1214), then in step S1216, the CPU 103 displays a UI for urging a user to register a target value in addition to an error message.

Figure 13:
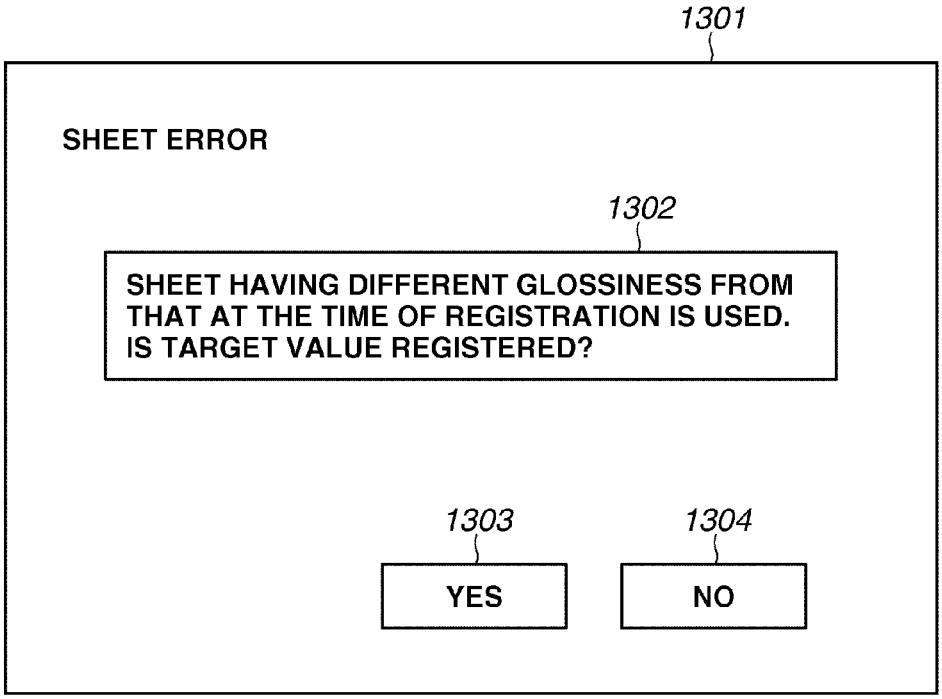
FIG. 13 illustrates a UI displayed during mixed color calibration performed in the second exemplary embodiment.

FIG. 13 illustrates an example of an error message on a UI. On a UI 1301, the fact that sheets having different glossinesses are respectively used at the time of target value registration and during mixed color calibration is presented to the user, to further make the user select whether read data is registered as a target value. A display device 118 includes touch-panel buttons 1302 and 1303. If the button 1302 is selected, it is determined that an instruction to register the target value has been accepted from the user. If the button 1303 is selected, it is determined that an instruction not to register the target value has been accepted from the user.

In step S1217, the CPU 103 then determines whether the instruction to register the target value has been accepted. If the instruction has not been accepted (NO in step S1217), the processing ends. If the instruction has been accepted (YES in step S1217), then in step S1218, the CPU 103 registers the target value and the glossiness. A measured value 1208 is added as a new target value to a target value (registered) 1202 stored in the storage device 121. A glossiness 1210 is added as a new glossiness to a glossiness (registered) 1212 stored in the storage device 121.

According to the present exemplary embodiment, in a system for calibrating a mixed color using sheets having different glossinesses, e.g., coated sheets, deterioration in accuracy during calibration due to a difference in the "glossiness" between the "target value" and the "measured value" can be prevented.

Further, according to the present exemplary embodiment, a case where the user has changed the sheet to be used can be dealt with by displaying the UI for urging the user to newly register the measured value as the target value when it is determined that the sheets have different glossinesses.

A third exemplary embodiment of the claimed invention in which it is determined whether a glossy sheet is used before a glossiness is determined during mixed color calibration will be described below.

In the above-mentioned second exemplary embodiment, processing for comparing the glossinesses respectively corresponding to the target value and the measured value during mixed color calibration and preventing deterioration in accuracy when the glossinesses differ has been described.

When the glossiness is determined, however, a processing time occurs for the determination. If less glossy plain sheets are used, a result that they are the same in glossiness may be obtained. Therefore, an unnecessary processing time may occur for a user who continues to use the plain sheets to determine the glossiness.

In the present exemplary embodiment, an example in which it is determined whether a glossy sheet is used before a glossiness is determined during mixed color calibration will be described in consideration of the above-mentioned situation.

Figure 14:
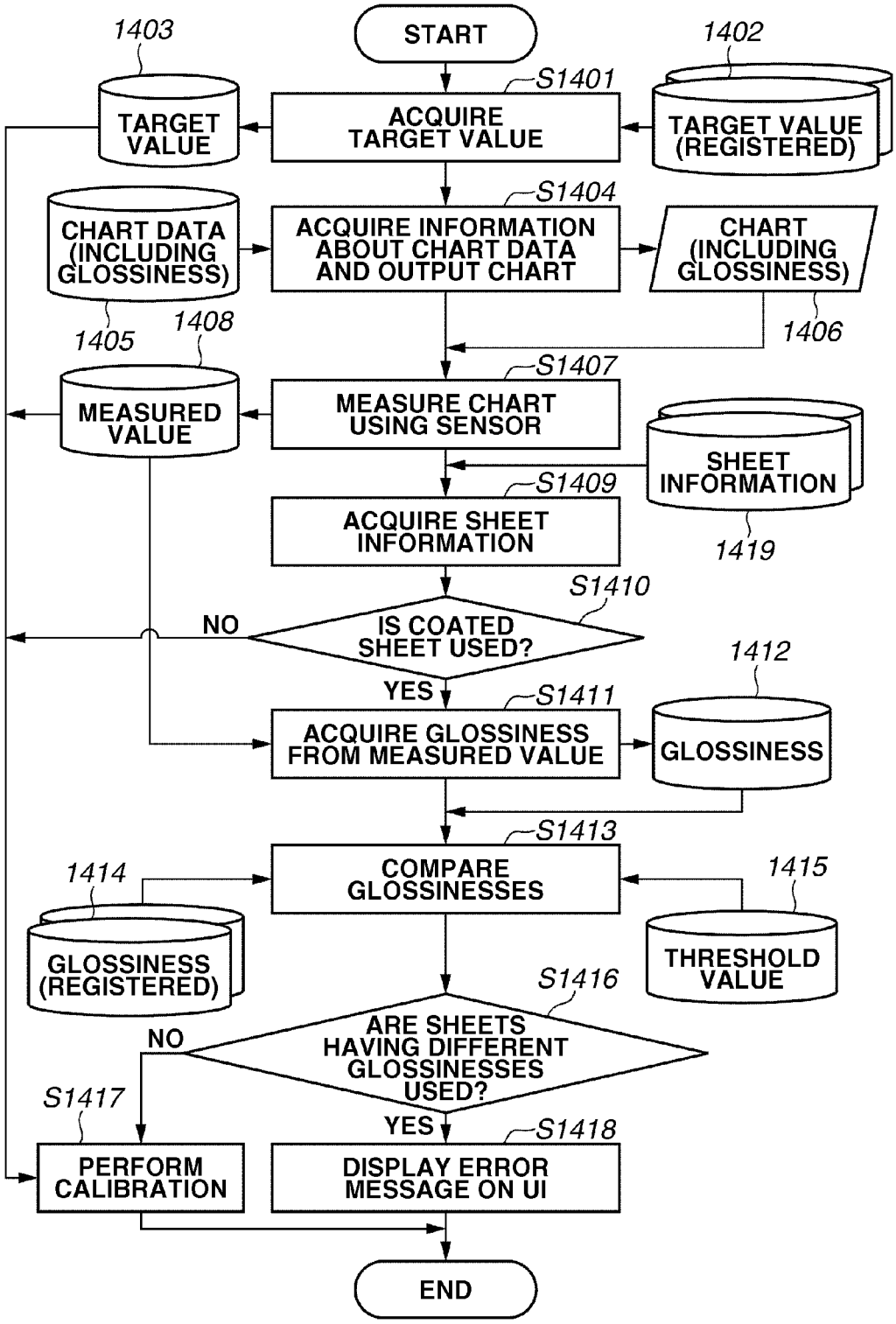
FIG. 14 is a flowchart illustrating a flow of mixed color calibration processing performed in a third exemplary embodiment.

FIG. 14 illustrates a flow of processing in the present exemplary embodiment. A program for realizing each step of the flow is loaded in the RAM and executed by the CPU 103 in the controller 102. Acquired data is stored in a storage device 121. A display device 118 displays an instruction to a user on a UI, and an instruction from the user is accepted from an input device 120.

The flow of processing in steps S1401 to S1407 illustrated in FIG. 14 is similar to the flow of processing in steps S701 to S707 illustrated in FIG. 7, and hence description thereof is not repeated.

In step S1409, the CPU 103 acquires sheet information about a chart 1406 from sheet information 1419 stored in the storage device 121. The sheet information includes a sheet type such as a plain sheet or a coated sheet, and a grammage and a size of the sheet. In the present exemplary embodiment, information about the sheet type is particularly acquired.

In step S1410, the CPU 103 then determines whether a coated sheet having a glossiness equal to or more than a threshold value is used as the sheet type when the chart 1406 is output. A user can set the threshold value of the glossiness. If it is determined that the coated sheet is not used (NO in step S1410), then in step S1417, the CPU 103 performs calibration processing by determining that the glossiness need not be determined because a less glossy sheet is used. If it is determined that the coated sheet is used (YES in step S1410), then in step S1411 and the subsequent steps, the CPU 103 performs glossiness determination processing because a glossy sheet is used.

The flow of processing in steps S1411 to S1418 illustrated in FIG. 14 is similar to the flow of processing in steps S709 to S716 illustrated in FIG. 7, and hence description thereof is not repeated.

According to the present exemplary embodiment, in a system for calibrating a mixed color using sheets having different glossinesses, e.g., coated sheets, deterioration in accuracy during calibration due to a difference in the "glossiness" between the "target value" and the "measured value" can be prevented.

Further, according to the present exemplary embodiment, processing for determining glossiness can be omitted when a less glossy sheet is used. Therefore, the speed of the processing can be increased.

A fourth exemplary embodiment of the claimed invention in which sheet information about a chart is acquired when a glossiness is determined during mixed color calibration, to switch a threshold value will be described below.

In the above-mentioned third exemplary embodiment, processing for comparing the glossinesses respectively corresponding to the target value and the measured value during mixed color calibration and preventing deterioration in accuracy when the glossinesses differ has been described.

However, some electrophotographic apparatuses may previously sub-divide sheet information. For example, the same coated sheets may be classified into a coated sheet having a low glossiness and a coated sheet having a high glossiness. An effect of a difference in glossiness on a hue/saturation may be non-linear. More specifically, an effect on a hue/saturation is not increased in proportion to a difference in glossiness, and is rapidly increased or decreased with the difference in glossiness as a boundary.

If the coated sheet having a low glossiness or the coated sheet having a high glossiness is used as a chart in such a situation, an accuracy of determination whether calibration can be performed may be reduced when a difference in glossiness is determined using the same threshold value TH between the coated sheet having a low glossiness and the coated sheet having a high glossiness.

For example, the higher the glossiness of the sheet used as the chart becomes, the farther a measured value obtained when a patch on the chart is measured becomes from that when a plain sheet is used as the chart. More specifically, the measured value of the patch on the chart may greatly deviate due to the difference in glossiness. In this case, when the same threshold value as that in the coated sheet having a high glossiness is used in the coated sheet having a low glossiness, an error determination may be made.

To determine whether calibration can be performed with higher accuracy, a sheet defined as a standard sheet is changed to match a characteristic of a sheet used as the chart, to set an appropriate threshold value TH.

If the coated sheet having a high glossiness is used, for example, a sheet having a high glossiness, which is previously registered, is selected as the standard sheet. If the coated sheet having a low glossiness is used, a sheet having a low glossiness, which is previously registered, is selected as the standard sheet. Thus, the threshold value TH is set to a value appropriate for the characteristic of the sheet used as the chart.

In the present exemplary embodiment, an example in which sheet information about a chart is acquired to switch threshold values when a glossiness is determined during mixed color calibration will be described in consideration of the above-mentioned situation.

Figure 15:
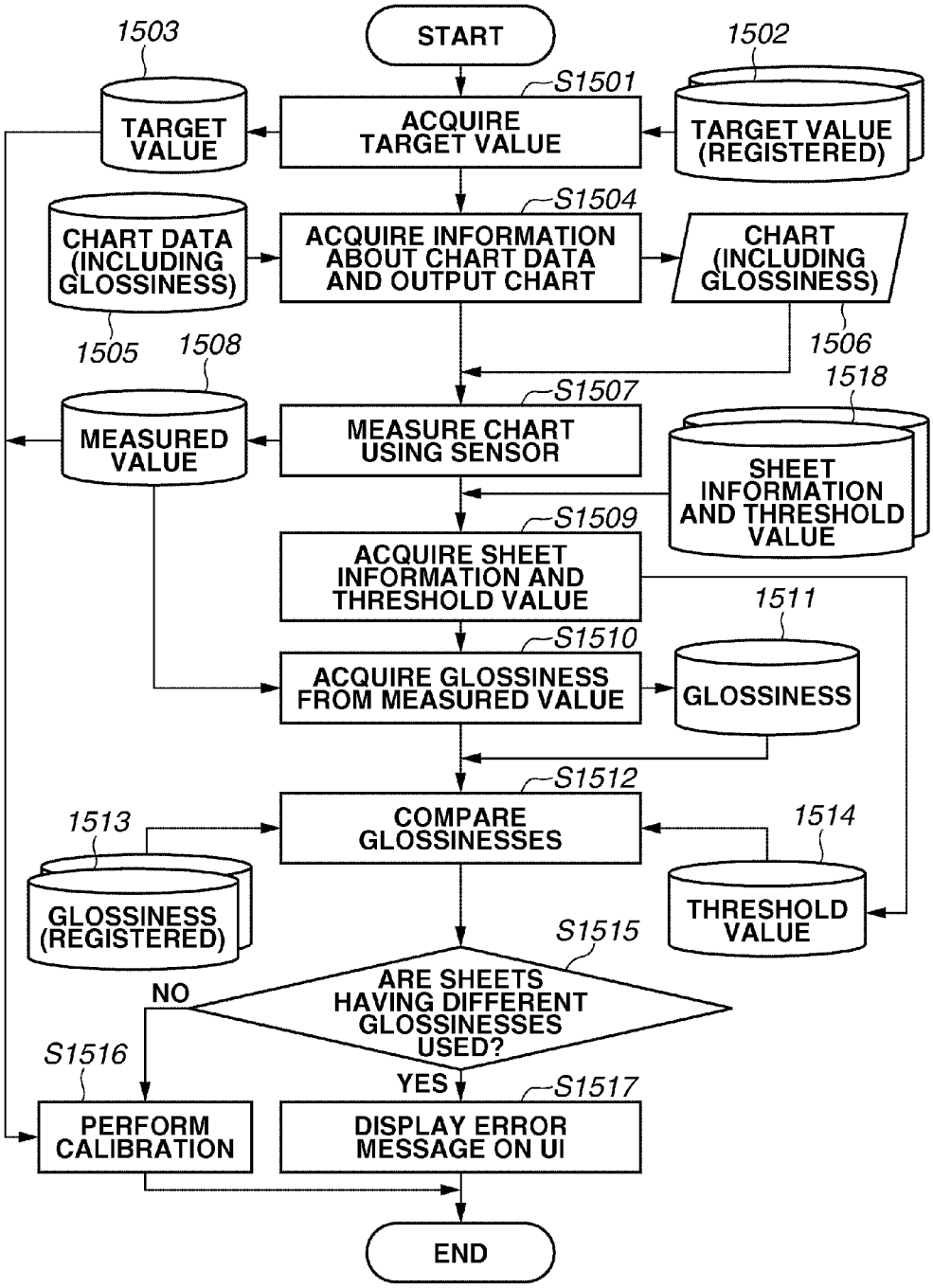
FIG. 15 illustrates a flow of mixed color calibration processing performed in a fourth exemplary embodiment.

FIG. 15 illustrates a flow of processing in the present exemplary embodiment. A program for realizing each step of the flow is loaded in the RAM and executed by the CPU 103 in the controller 102. Acquired data is stored in a storage device 121. A display device 118 displays an instruction to a user on a UI, and an instruction from the user is accepted from an input device 120.

The flow of processing in steps S1501 to S1507 illustrated in FIG. 15 is similar to the flow of processing in steps S701 to S707 illustrated in FIG. 7, and hence description thereof is not repeated.

In step S1509, the CPU 103 acquires sheet information about a chart 1506 and a threshold value corresponding to the sheet information as a threshold value 1514 from sheet information and a threshold value 1518, which are stored in the storage device 121. The sheet information includes a sheet type such as a plain sheet, a coated sheet having a low glossiness, or a coated sheet having a high glossiness, and a grammage and a size of the sheet. The threshold value is individually set corresponding to the sheet information, and particularly corresponding to the sheet type in the present exemplary embodiment.

The flow of processing in steps S1510 to S1517 illustrated in FIG. 15 is similar to the flow of processing in steps S709 to S716 illustrated in FIG. 7, and hence description thereof is not repeated. Particularly comparison of the glossinesses in step S1512, the threshold value 1514 corresponding to the sheet information is used.

While the sheet information about the chart is acquired to switch the threshold values when the glossiness is determined in the present exemplary embodiment, this may be combined with processing for determining whether a sheet is glossy, to determine glossiness only when the sheet is glossy, as described in the third exemplary embodiment.

According to the present exemplary embodiment, in a system for calibrating a mixed color using sheets having different glossinesses, e.g., coated sheets, deterioration in accuracy during calibration due to a difference in the "glossiness" between the "target value" and the "measured value" can be prevented.

Further, according to the present exemplary embodiment, the threshold value for determining the glossiness is changed depending on the sheet type. Therefore, an accuracy of the determination of the glossiness can be improved.

A fifth exemplary embodiment of the claimed invention in which target values respectively having similar glossinesses are searched for when it is determined that glossinesses differ during mixed color calibration will be described below.

In the above-mentioned exemplary embodiment, processing for comparing the glossinesses respectively corresponding to the target value and the measured value during mixed color calibration and preventing deterioration in accuracy when the glossinesses differ has been described.

However, it may be difficult to determine which of target values already registered is close in glossiness to the measured value during calibration in a solution in the above-mentioned exemplary embodiment.

Accordingly, in the present exemplary embodiment, an example in which target values respectively having similar glossinesses are searched for when it is determined that the glossinesses differ during mixed color calibration in consideration of the above-mentioned situation.

Figure 16:
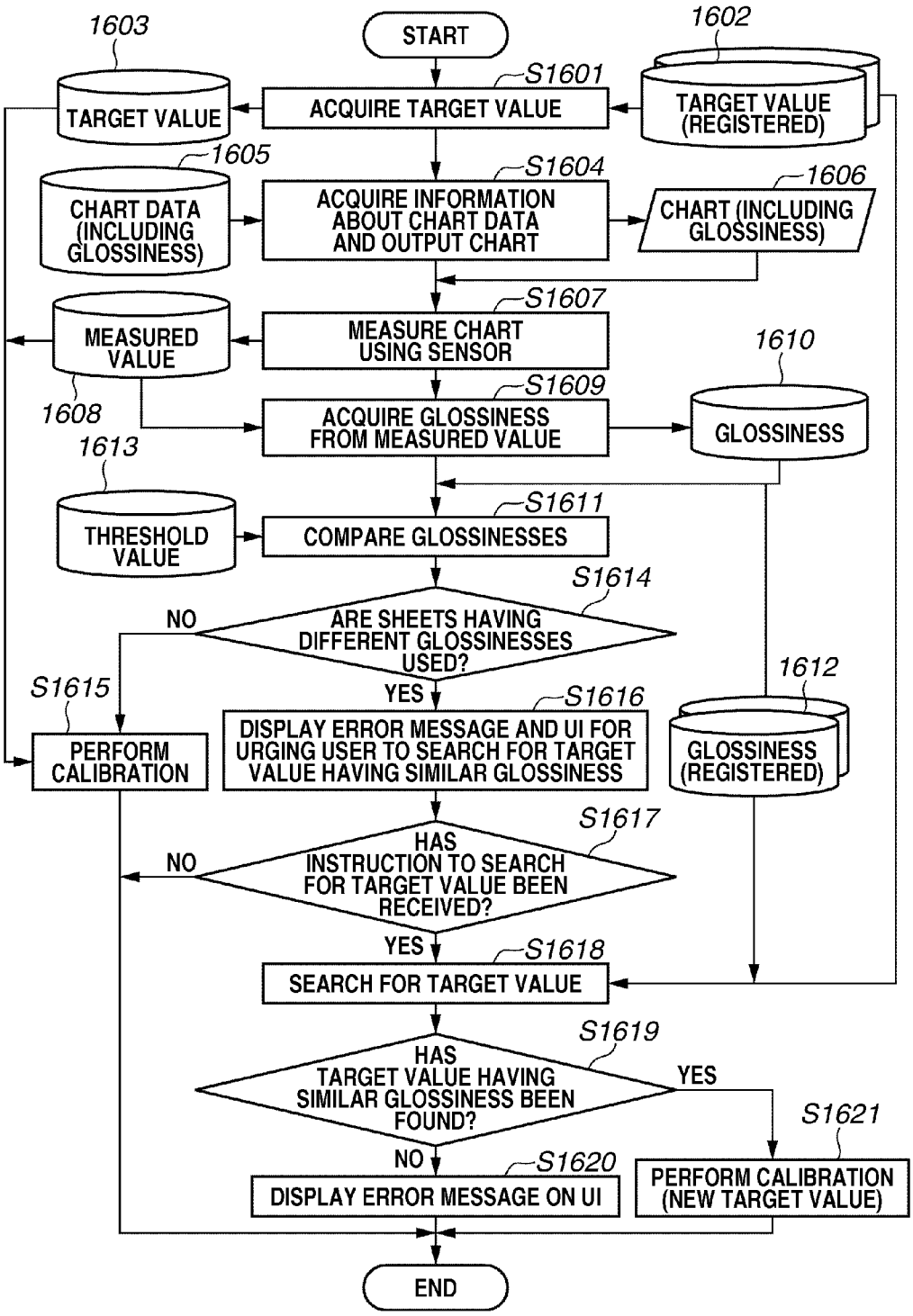
FIG. 16 illustrates a flow of mixed color calibration processing performed in a fifth exemplary embodiment.

FIG. 16 illustrates a flow of processing in the present exemplary embodiment. A program for realizing each step of the flow is loaded in the RAM and executed by the CPU 103 in the controller 102. Acquired data is stored in a storage device 121. A display device 118 displays an instruction to a user on a UI, and an instruction from the user is accepted from an input device 120.

The flow of processing in steps S1601 to S1615 illustrated in FIG. 16 is similar to the flow of processing in step S701 to S715 illustrated in FIG. 7, and hence description thereof is not repeated.

If it is determined that sheets having different glossinesses are used (YES in step S1614), then in step S1616, the CPU 103 displays an error message and a UI for urging the user to search for a target value having similar glossiness.

Figure 17:
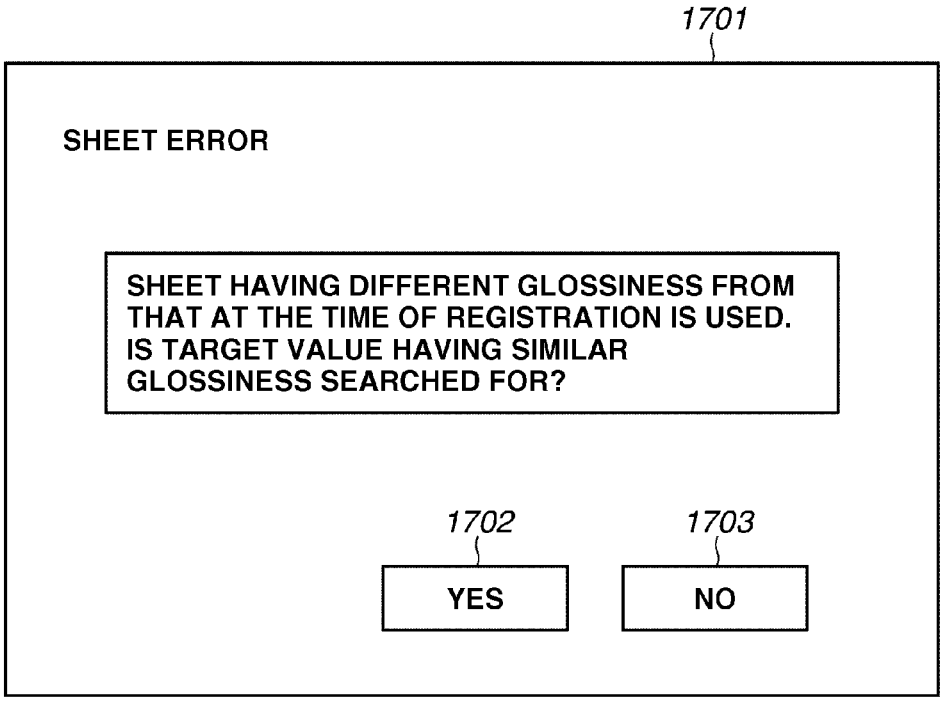
FIG. 17 illustrates a UI displayed during mixed color calibration performed in the fifth exemplary embodiment.

FIG. 17 illustrates an example of a UI. On a UI 1701, the fact that the sheets having different glossinesses are respectively used at the time of target value registration and during mixed color calibration is presented to the user, to further urges the user to select whether the target values respectively having similar glossinesses are searched for. A display device 118 has touch-panel buttons 1702 and 1703. If the button 1702 is selected, it is determined that an instruction to search for the target value has been accepted from the user. If the button 1703 is selected, it is determined that an instruction not to search for the target value is accepted from the user.

In step S1617, the CPU 103 then determines whether an instruction to search for a target value has been accepted. If the instruction has not been accepted (NO in step S1617), the processing ends. If the instruction has been accepted (YES in step S1617), then in step S1618, the CPU 103 acquires a glossiness (registered) 1612 and a target value (registered) 1602, which are stored in the storage device 121, and searches for target values respectively having similar glossinesses.

In step S1619, the CPU 103 then determines whether the target value having similar glossiness has been found. If the target value has not been found (NO in step S1619), then in step S1620, the CPU 103 displays an error message on the UI. If the target value has been found (YES in step S1619), then in step S1621, the CPU 103 performs calibration processing using a new target value found by the search.

While a method for searching for the target values respectively having similar glossiness when it is determined that the glossinesses differ has been described in the present exemplary embodiment, an acquired value may be registered as a new target value, as described in the second exemplary embodiment, when the target value has not been found after the search.

According to the present exemplary embodiment, in a system for calibrating a mixed color using sheets having different glossinesses, e.g., coated sheets, deterioration in accuracy during calibration due to a difference in the "glossiness" between the "target value" and the "measured value" can be prevented.

Further, according to the present exemplary embodiment, the target values respectively having similar glossiness can be searched for. Therefore, the user can be notified whether the registered target values include ones having similar glossinesses.

Aspects of the claimed invention can also be realized by a computer of a system or apparatus (or devices such as a CPU, a micro processing unit (MPU), and/or the like) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., a non-transitory computer-readable medium). In such a case, the system or apparatus, and the recording medium where the program is stored, are included as being within the scope of the claimed invention.

While the claimed invention has been described with reference to exemplary embodiments, it is to be understood that the claimed invention is not limited to the disclosed exemplary embodiments. The scope of the following claims is to be accorded the broadest interpretation so as to encompass all modifications, equivalent structures, and functions.

This application claims priority from Japanese Patent Application No. 2011-246703 filed Nov. 10, 2011, which is hereby incorporated by reference herein in its entirety.

What is claimed is:

1. An image processing apparatus comprising:

a first acquisition unit configured to acquire a target value and a first surface characteristic value that is a surface characteristic of a first chart;

a second acquisition unit configured to acquire a second surface characteristic value that is a surface characteristic of a second chart;

a calibration unit configured to calibrate, when a difference between the first surface characteristic value and the second surface characteristic value is smaller than a threshold value, a mixed color using the target value and a measured value of the second chart; and a display unit configured to display, when it is determined that there is a difference equal to or larger than the threshold value between the first surface characteristic value and the second characteristic value, that an error has occurred.

2. The image processing apparatus according to claim 1, wherein the surface characteristic value is a glossiness value, and the glossiness value is obtained from a hue value and a saturation value or a spectral reflectance value acquired by measuring each of the first chart and the second chart.

3. The image processing apparatus according to claim 1, wherein each of the first chart and the second chart includes information for calibrating the mixed color and information for acquiring the surface characteristic value.

4. The image processing apparatus according to claim 1, wherein the surface characteristic value is obtained by measuring a paper white portion of each of the first chart and the second chart.

5. The image processing apparatus according to claim 1, wherein the surface characteristic value is obtained by measuring a portion printed with a single-color toner, of each of the first chart and the second chart.

6. The image processing apparatus according to claim 1, wherein a user interface for urging a user to register the measured value of the second chart as a target value substitute for the target value is displayed on the display unit.

7. The image processing apparatus according to claim 1, wherein the measured value of the second chart is registered as a target value when an instruction to register the measured value of the second chart as a target value substitute for the target value is received.

8. The image processing apparatus according to claim 1, wherein the second acquisition unit acquires the second surface characteristic value of the second chart only when the second surface characteristic value is the threshold value or larger.

9. The image processing apparatus according to claim 1, wherein a user interface (UI) for urging a user to search for a target value having a glossiness value similar to the second surface characteristic value acquired by the second acquisition unit is displayed on the display unit.

10. The image processing apparatus according to claim 9, wherein a UI for urging a user to search for the target value having the glossiness value similar to the second surface characteristic value is displayed, to calibrate, when an instruction to search for the target value having the similar glossiness value is received, a mixed color using the target value if the target value can be found, and display an error message if the target value cannot be found.

11. The image processing apparatus according to claim 1, wherein a user is allowed to select which of a processing accuracy and a processing speed is given priority to when a determination is performed.

12. The image processing apparatus according to claim 1, further comprising:

a sensor for measuring a measured value of the first chart and a measured value of the second chart, wherein the sensor acquires each measured value as a device-independent value.

13. The image processing apparatus according to claim 1, further comprising:

a sensor for measuring a measured value of the first chart and a measured value of the second chart, wherein the sensor acquires each measured value as a device-dependent value, and each measured value is converted into a device-independent value by using an arithmetic operation.

14. An image processing method comprising:

acquiring a target value and a first surface characteristic value that is a surface characteristic of a first chart;

acquiring a second surface characteristic value that is a surface characteristic of a second chart;

calibrating, when it is determined that a difference between the first surface characteristic value and the second surface characteristic value is smaller than a threshold value, a mixed color using the target value and a measured value of the second chart; and displaying on a display unit, when it is determined that there is a difference equal to or larger than the threshold value between the first surface characteristic value and the second characteristic value, that an error has occurred.

15. The image processing method according to claim 14, wherein the surface characteristic value is a glossiness value, and the glossiness value is obtained from a hue value and a saturation value or a spectral reflectance value acquired by measuring each of the first chart and the second chart.

16. The image processing method according to claim 14, wherein each of the first chart and the second chart includes information for calibrating the mixed color and information for acquiring the surface characteristic value.

17. The image processing method according to claim 14, wherein the surface characteristic value is obtained by measuring a paper white portion of each of the first chart and the second chart.

18. The image processing method according to claim 14, wherein the surface characteristic value is obtained by measuring a portion which printed with a single-color toner, of each of the first chart and the second chart.

19. The image processing method according to claim 14, wherein a user interface for urging a user to register the measured value of the second chart as a target value substitute for the target value is displayed on the display unit.

20. The image processing method according to claim 14, wherein the measured value of the second chart is registered as a target value when an instruction to register the measured value of the second chart as a target value substitute for the target value is received.

21. The image processing method according to claim 14, wherein the second surface characteristic value of the second chart is acquired only when the second surface characteristic value is the threshold value or larger.

22. The image processing method according to claim 14, wherein a user interface (UI) for urging a user to search for a target value having a glossiness value similar to the acquired second surface characteristic value is displayed on the display unit.

23. The image processing method according to claim 22, wherein a UI for urging a user to search for the target value having the glossiness value similar to the second surface characteristic value is displayed, to calibrate, when an instruction to search for a target value having the similar glossiness value is received, a mixed color using the target value if the target value can be found, and display an error message if the target value cannot be found.

24. The image processing method according to claim 14, wherein a user is allowed to select which of a processing accuracy and a processing speed is given priority to when determination is performed.

25. The image processing method according to claim 14, further comprising:

a sensor for measuring a measured value of the first chart and a measured value of the second chart, wherein the sensor acquires each measured value as a device-independent value.

26. The image processing method according to claim 14, further comprising:

a sensor for measuring a measured value of the first chart and a measured value of the second chart, wherein the sensor acquires each measured value as a device-dependent value, and each measured value is converted into a device-independent value by using an arithmetic operation.

27. A non-transitory computer-readable storage medium storing a program for causing a computer to perform an image processing method comprising:

acquiring a target value and a first surface characteristic value that is a surface characteristic of a first chart;

acquiring a second surface characteristic value that is a surface characteristic of a second chart;

calibrating, when it is determined that a difference between the first surface characteristic value and the second surface characteristic value is smaller than a threshold value, a mixed color using the target value and a measured value of the second chart; and displaying on a display unit, when it is determined that there is a difference equal to or lamer than the threshold value between the first surface characteristic value and the second characteristic value, that an error has occurred.

* * * * *